US011717058B2

(12) United States Patent
Poulter et al.

(10) Patent No.: US 11,717,058 B2
(45) Date of Patent: Aug. 8, 2023

(54) TRACTION CLEAT SYSTEM AND APPARATUS FOR ATHLETIC SHOE, AND ATHLETIC SHOE INCLUDING SAME

(71) Applicant: Clint Poulter, San Antonio, TX (US)

(72) Inventors: Clinton George Poulter, San Antonio, TX (US); Kit Morris, Austin, TX (US)

( * ) Notice: Subject to any disclaimer, the term of this patent is extended or adjusted under 35 U.S.C. 154(b) by 0 days.

(21) Appl. No.: 17/209,744

(22) Filed: Mar. 23, 2021

(65) Prior Publication Data

US 2022/0304426 A1 Sep. 29, 2022

(51) Int. Cl.
*A43C 15/16* (2006.01)
*A43B 5/00* (2022.01)

(52) U.S. Cl.
CPC ..... *A43C 15/161* (2013.01); *A43C 15/165* (2013.01); *A43B 5/001* (2013.01)

(58) Field of Classification Search
CPC ..... A43C 15/161; A43C 15/165; A43B 5/001
USPC ..... 36/134, 67 d
See application file for complete search history.

(56) References Cited

U.S. PATENT DOCUMENTS 6,154,984 A * 12/2000 Adam ..... A43B 5/001 36/62
6,305,104 B1 10/2001 McMullin
7,752,775 B2 * 7/2010 Lyden ..... A43D 1/02 36/129
8,667,714 B2 3/2014 Burt et al.
2006/0059723 A1 * 3/2006 Robinson, Jr. ..... A43B 3/0042 36/134
2008/0072460 A1 * 3/2008 Robinson ..... A43C 15/161 36/134
2008/0222924 A1 * 9/2008 Carruthers ..... A43C 15/161 36/67 D
2009/0307933 A1 * 12/2009 Leach ..... A43C 15/161 36/62
2019/0343237 A1 * 11/2019 Stuart ..... A43C 13/04

* cited by examiner

*Primary Examiner* — Ted Kavanaugh
(74) *Attorney, Agent, or Firm* — Artie Pennington Law Offices, PLLC; Artie Pennington; Hannah Ward

(57) ABSTRACT

A traction cleat assembly for a golf shoe includes a hub and removable cover affixed to the hub body in a fixed position with mated sealing engagement between the hub and removable cover defining a, the hub body including a minor driven fitting comprising one of a female fitting and male fitting defined in the hub bottom surface, and the cover top surface including a minor driving fitting for mating engagement with the minor driven fitting to define mated engagement therebetween.

11 Claims, 21 Drawing Sheets

TRACTION CLEAT SYSTEM AND APPARATUS FOR ATHLETIC SHOE, AND ATHLETIC SHOE INCLUDING SAME

CROSS REFERENCE TO RELATED APPLICATIONS

This application on the date of filing is not related to any other provisional or non-provisional application and does not claim priority to any other application.

FIELD OF THE INVENTION

The disclosure relates generally to athletic shoes, such as golf shoes, having traction cleats for improving traction on the ground or turf.

BACKGROUND OF THE INVENTION

The disclosure pertains to athletic shoes, such as golf shoes, having traction cleats for improving traction on the ground or turf. This disclosure, more particularly, pertains to improved traction cleat systems and apparatuses for athletic shoes, and athletic shoes including improved traction cleat systems and apparatuses. Although embodiments disclosed herein are used primarily in golf shoes, it is to be understood that the disclosed systems, apparatuses, and methods have application in any athletic shoe that utilizes detachable traction cleats.

Unexpected slipping when playing sports on turf is not desired and can cause poor performance. Many athletic shoes for use on turf include traction cleats for improving traction. Specifically, when playing golf, the player's feet slipping during the golf swing tends to cause poor play. For at least this reason, golf shoes are worn to reduce slipping. Golf shoes may include a set of traction cleats (hereinafter "cleats" or "traction cleats") mounted to the outsole to engage the ground and reduce slipping of the feet relative to the ground or turf ("ground"). Traction cleats may be made of flexible, relatively soft materials, such as polyurethane or similar plastic materials, which may provide user comfort during wear and minimize damage to the turf on the golf course.

Traction cleats are degraded and worn down by repeated wearing over numerous rounds of golf. Traction cleats, when excessively degraded and worn-down, may be intended to be removed from the golf shoes and replaced with new cleats. Many golfers, however, find it difficult to remove worn down cleats from their golf shoes, and choose to forego replacing their worn-down cleats. One major problem encountered by golfers attempting to remove worn-down cleats and replace them, is that removing worn-down cleats may be very difficult or impossible due to the presence of compacted debris such as soil and pebbles that clogs and cannot readily be removed from the cleats, or if the compacted debris is removed by force, is likely to result in damaging the golf shoes or some cleats being removed before the golfer surrenders and is forced to leave several ruined cleats that remain stuck in cleat receptacles in the outsole. Golfers thus may continue wearing their golf shoes having all or several worn-down cleats, long past the useful life of the cleats. In order to avoid the difficulties of removing worn-down cleats from their used golf shoes, many golfers choose expediency and incur the high cost of purchasing new golf shoes having pre-installed new cleats and discarding their used golf shoes with useless, worn-out cleats. For reasons stated above and for other reasons which will become apparent to those skilled in the art upon reading and understanding the present specification, there is a need in the art for improved traction cleat systems and apparatus for athletic shoes, athletic shoes including same, and methods for athletic shoes having traction cleats.

BRIEF DESCRIPTION OF THE INVENTION

The above-mentioned shortcomings, disadvantages and problems are addressed herein, as will be understood by those skilled in the art upon reading and studying the following specification. This Brief Description is provided to introduce a selection of concepts in a simplified form that are further described below in more detail in the Detailed Description. This Brief Description is not intended to identify key or essential features of the claimed subject matter.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In one aspect, a traction cleat system for an athletic shoe may include a removal fitting located in a clean zone defined by at least one debris seal, such that the removal fitting and clean zone are maintained in clean condition that is free of compacted debris during ordinary use of the athletic shoe, until it is desired to access and manipulate the removal fitting to rotate and remove the traction cleat system from the athletic shoe.

In one aspect, a traction cleat system may include a major hub having a hub body and removable cover affixed thereto by positive engagement between the hub body and removable cover. The positive engagement between the hub body and removable cover may include engagement in an interference fit relationship in an interference fit zone formed by engagement between hub body and removable cover, and may include engagement in a snap-fit relationship in a snap-fit engagement zone. The positive engagement may define at least a first debris seal formed by first mated sealing engagement between the hub body and removeable cover to isolate a clean zone including an enclosed portion of the traction cleat assembly from open communication with the external environment to prevent particulate debris from entering and fouling the clean zone including the enclosed portion, and to prevent debris from fouling a minor removal fitting, which may be a minor driven fitting, disposed in the clean zone. The positive engagement between the hub body and removable cover may also define a second debris seal formed by second mated engagement between the minor removal fitting, which may be a minor minor driven fitting, on the hub in the clean zone, and a complementary minor filling fitting, which may be a minor filling projection, on the cover top surface of the removable cover in the clean zone, to isolate the clean zone from open communication with the external environment to prevent particulate debris from entering and fouling the minor removal fitting. Isolation of the clean zone and minor removal fitting to prevent fouling by particulate debris thus maintains the removal fitting in accessible, ready and operable condition for engagement with a complementary manual tool for manipulating the removal fitting to rotate and remove the traction cleat system from the outsole of the athletic shoe.

Apparatus, systems, and methods of varying scope are described herein. These aspects are indicative of various non-limiting ways in which the disclosed subject matter may be utilized, all of which are intended to be within the scope of the disclosed subject matter. In addition to the aspects and advantages described in this summary, further aspects, features, and advantages will become apparent by reference to the associated drawings, detailed description, and claims.

BRIEF DESCRIPTION OF THE DRAWINGS

The disclosed subject matter itself, as well as further objectives, and advantages thereof, will best be illustrated by reference to the following detailed description of embodiments of the device read in conjunction with the accompanying drawings, wherein.

DETAILED DESCRIPTION OF THE INVENTION

Figure 1:
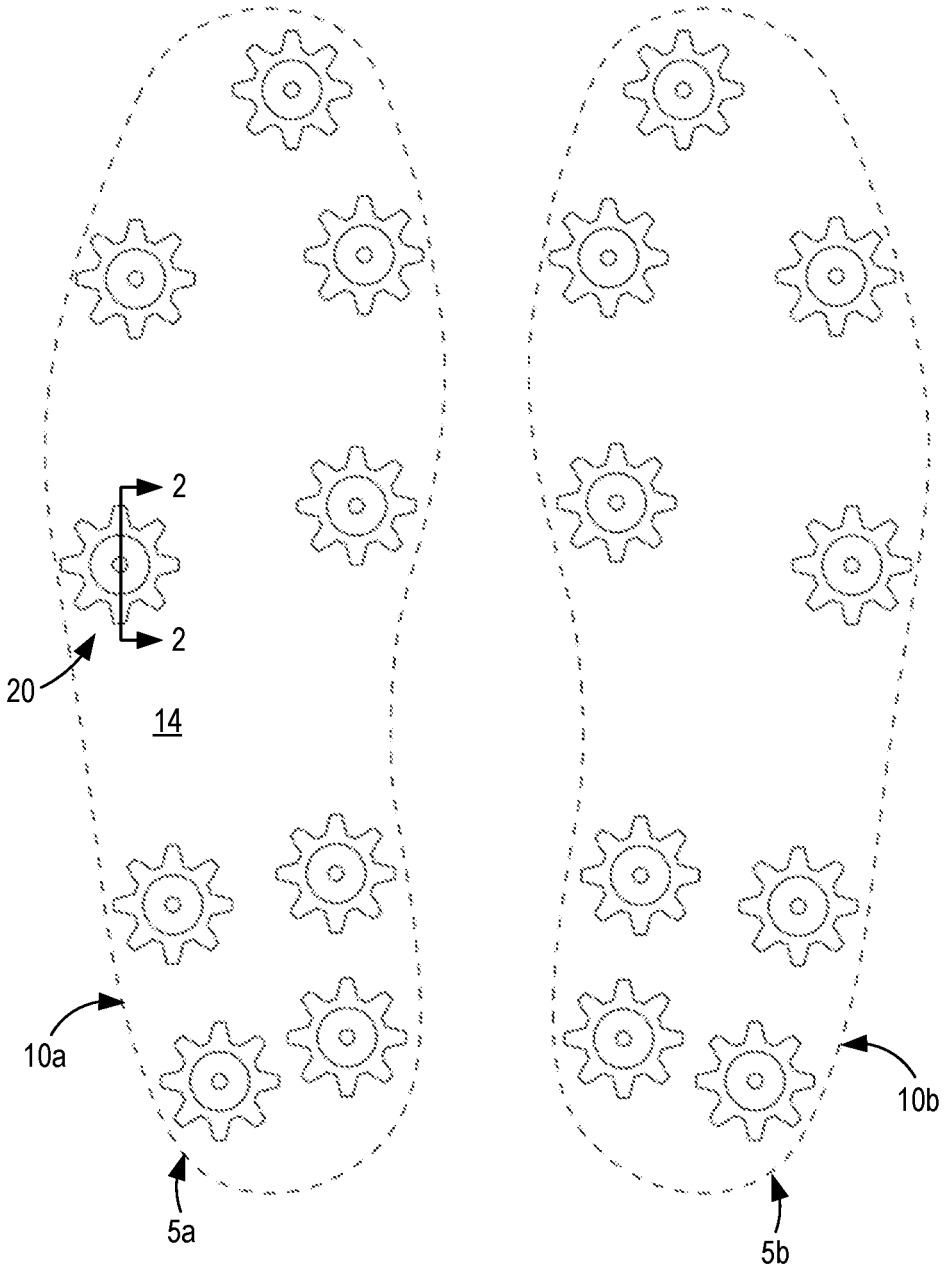
FIG. 1 is bottom view of athletic shoes having a traction cleat system in a first embodiment.

The following detailed description, reference is made to the accompanying drawings which form a part hereof, and in which is shown by way of illustration specific embodiments which may be practiced. These embodiments are described in sufficient detail to enable those skilled in the art to practice the embodiments and disclosure. It is to be understood that other embodiments may be utilized, and that logical, mechanical, electrical, and other changes may be made without departing from the scope of the embodiments and disclosure. In view of the foregoing, the following detailed description is not to be taken as limiting the scope of the embodiments or disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be appreciated that for simplicity and clarity of illustration, where considered appropriate, reference numerals may be repeated among the figures to indicate corresponding or analogous elements. In addition, numerous specific details are set forth in order to provide a thorough understanding of the implementations described herein. However, it will be understood by those of ordinary skill in the art that the implementations described herein may be practiced without these specific details. In other instances, well-known methods, procedures and components have not been described in detail so as not to obscure the implementations described herein. Also, the description is not to be considered as limiting the scope of the implementations described herein.

The detailed description set forth herein in connection with the appended drawings is intended as a description of exemplary embodiments in which the presently disclosed apparatus and system can be practiced. The term "exemplary" used throughout this description means "serving as an example, instance, or illustration," and should not necessarily be construed as preferred or advantageous over other embodiments.

The terms "upper", "top", "lower", "bottom", "vertical", "horizontal", etc., are used for convenience to refer to the orientation of a cleat when attached to a shoe sole resting on the ground and are not intended to otherwise limit the structures described and claimed. The terms "axial", "axially", "longitudinal", "longitudinally", etc., refer to dimensions extending parallel to the central axis about which the cleat extends into the shoe sole and perpendicular to flat ground. The terms "radial", "radially", "lateral", 'laterally", etc., refer to dimensions extending perpendicularly from the cleat central axis and substantially parallel to the shoe sole and flat ground. The terms "angle", "angular", "rotationally", etc., unless otherwise stated refer to rotation dimension about the cleat central axis. The terms "attach", "attachment", etc., pertain to a longitudinal engagement between assembled distinct parts of the cleat assembly, which may be attached to each other, or detached from each other. The terms "lock", "locking", etc., pertain to preventing inadvertent displacement or detachment between parts of the cleat assembly.

FIG. 1 is bottom view of a pair of athletic shoes 5*a*, 5*b* each having a plurality of traction cleat systems 20 in a first embodiment detachably mounted in cleat receptacles (not shown) spaced apart in the bottom surfaces 10*a*, 10*b* in the outsole 14 thereof. In the specific embodiment shown in FIG. 1, the pair of athletic shoes 5*a*, 5*b* are golf shoes.

Figure 2:
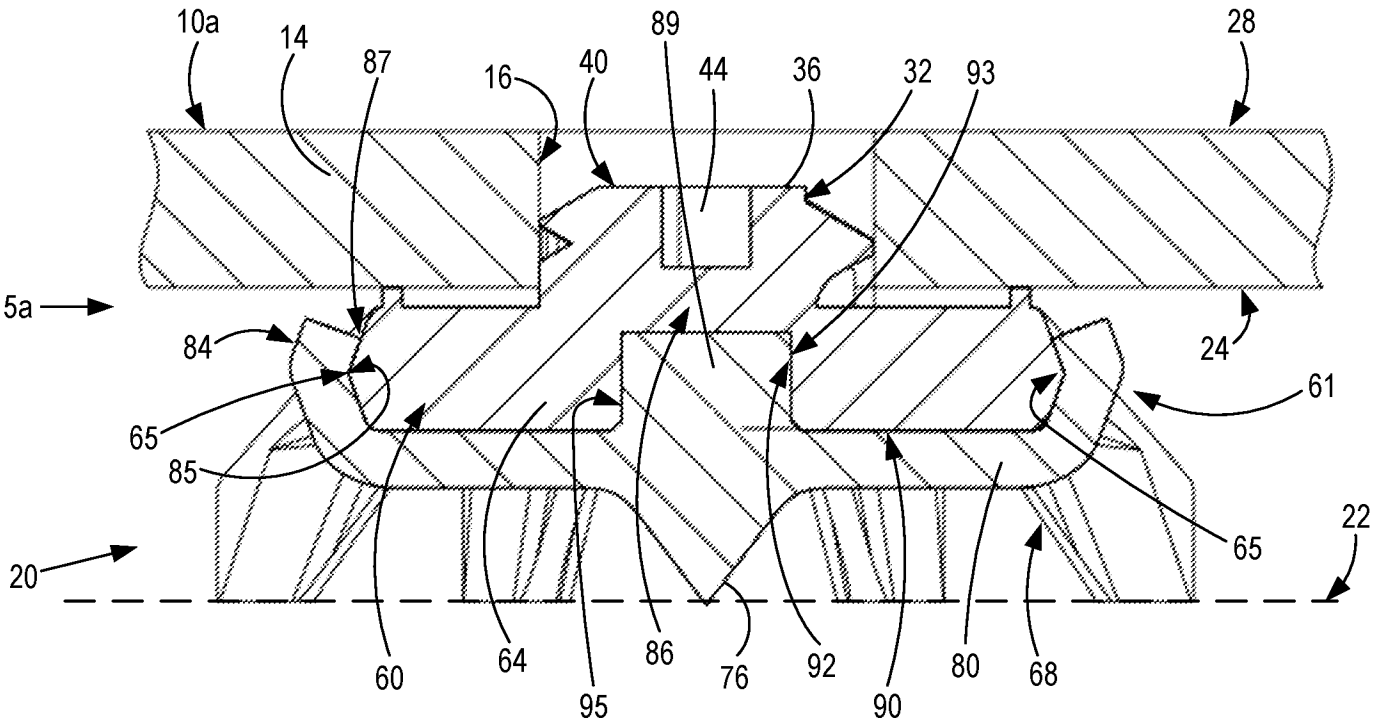
FIG. 2 is an enlarged, simplified, partial cross-sectional view taken generally along 2-2 in FIG. 1.

FIG. 2 is an enlarged, simplified, partial cross-sectional view taken generally along 2-2 in FIG. 1. Athletic shoe 5*a* includes outsole 14 having a bottom surface 24. Outsole 14 may include an upper surface 28 spaced from the bottom surface 24, which may be joined to a different layer or component of the athletic shoe 5*a*, as construction techniques of same may vary. Outsole 14 includes a cleat receptacle 16 configured to receive the connection stem 40 of traction cleat system 20 to mount or affix the traction cleat system 20 to the outsole 14 of athletic shoe 5*a* in removable or detachable relationship with outsole 14 of athletic shoe 5*a*. Connection stem 40 may include male threads 32 to engage cleat receptacle 16 having a flange or female thread 32 in mating threaded relationship to affix the traction cleat system 20 to the outsole 14. Traction cleat system 20 may include major hub 60 including hub body 64. Major hub 60 also may include a plurality of elongated traction elements 68 extending downward from hub body 64 to engage the ground 22. Traction cleat system 20 may include removable cover 80 configured for positive engagement with hub body 64 to define at least one debris seal 90 therebetween. Removable cover 80 may include a plurality of keeper arms 84 extending above at least a portion of the hub body 64 to form an interference fit therebetween. The interference fit may be a snap-fit relationship formed between at least a portion of the hub body 64 and the plurality of keeper arms 84 extending above at least a portion of the hub body 64. Traction cleat system 20 may include a clean zone 92 defined inside the at least one debris seal 90 in isolated, clean condition with the at least one debris seal 90 preventing open communication of particulate debris from the external environment to the clean zone 92. Traction cleat system 20 may include a minor removal fitting 96 disposed in the clean zone 92 in isolated, clean condition with the at least one debris seal 90 preventing open communication of particulate debris from the external environment to the minor removal fitting 96 in clean zone 92. As used herein, the isolated, clean condition includes the clean zone 92 and minor removal fitting 96 disposed therein being maintained in clean condition that is isolated and free from entry of particulate debris, including compacted debris, from the external environment during ordinary use of the athletic shoe, and the clean condition continuing until it is desired to remove the removable cover 80 from positive engagement with the hub body 64 to access and manipulate the minor removal fitting 96 in clean condition free of debris, to remove the traction cleat system 20 from the athletic shoe 52.

Figure 3:
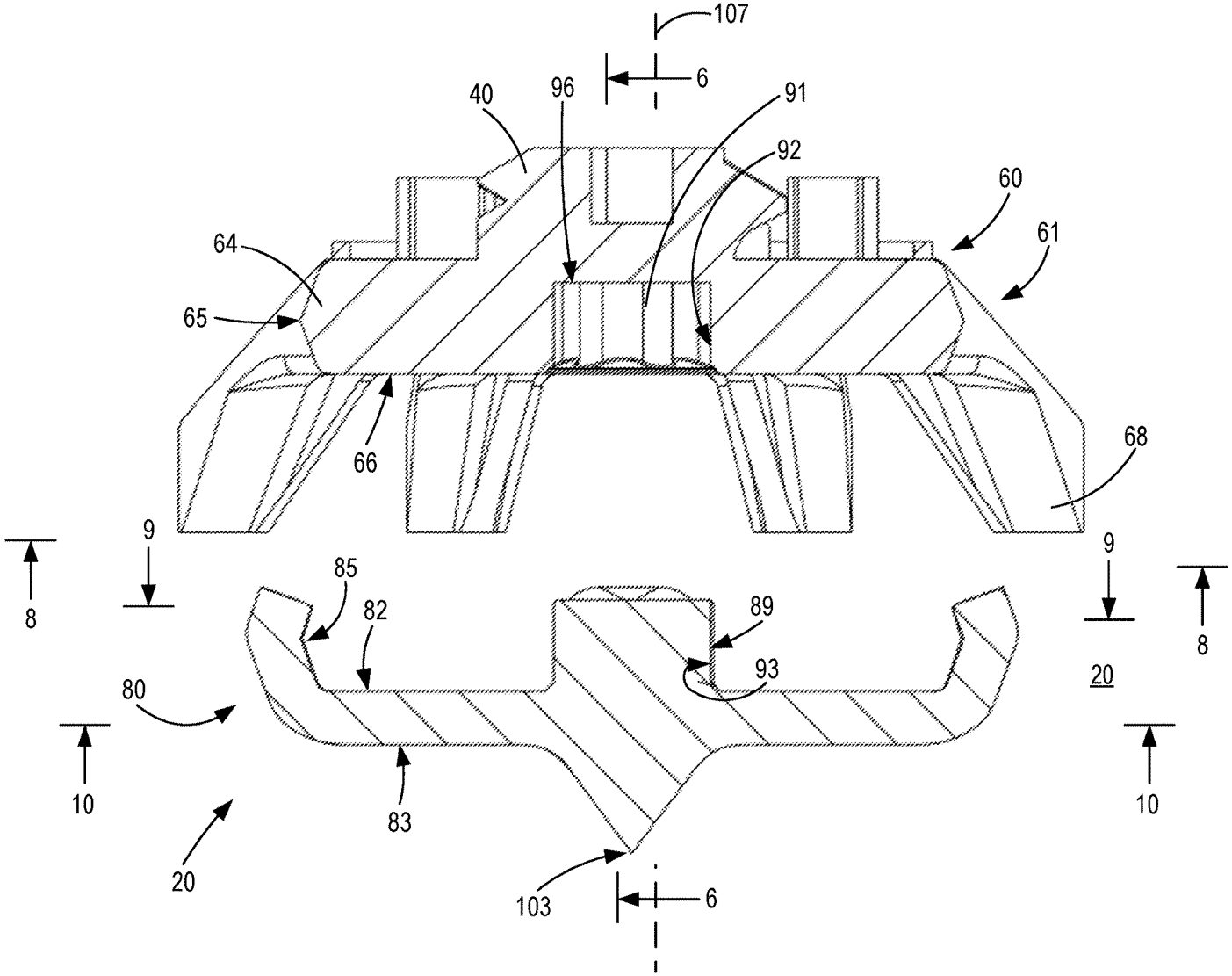
FIG. 3 is an enlarged, partial cross-sectional, exploded assembly view of the traction cleat system in the first embodiment shown generally in FIG. 2.

FIG. 3 is an enlarged, partial cross-sectional, exploded assembly view of the traction cleat system 20 in the first embodiment shown generally in FIG. 2. Traction cleat system 20 may include connection stem 40 adjoining major hub 60 having hub body 64. Major hub 60 may include a plurality of elongated traction elements 68 extending downward from hub body 64 to engage the ground (not shown in FIG. 3). Traction cleat system 20 may include removable cover 80 configured for positive engagement with hub body 64 to define at least a first debris seal 90 (shown in FIG. 2) therebetween along a continuous seal interface formed between hub bottom surface 66 and cover top surface 82. Referring to FIG. 3, removable cover 80 may include a plurality of keeper arms 84 each having a capturing turn 85 and extending above at least a corresponding captured rim 65 of hub body periphery 61 of the hub body 64 to form an interference fit zone 87 (shown in FIG. 2) therebetween and draw the cover top surface 82 into mated sealing engagement with the hub bottom surface 66 at a continuous sealing interface 90 (shown in FIG. 2). Referring to FIG. 2, the interference fit zone 87 formed between each of the keeper arms 84 having capturing turn 85 with corresponding captured rim 65 of the hub body 64 may be a snap-fit relationship. Referring to FIG. 3, traction cleat system 20 may include a clean zone 92 defined inside the at least one debris seal 90 in isolated, clean condition behind or within the at least a first debris seal 90 (shown in FIG. 2) preventing open communication of particulate debris from the external environment to the clean zone 92. Referring to FIG. 3, traction cleat system 20 may include a minor removal fitting 96 disposed in the clean zone 92 in isolated, clean condition. Traction cleat system 20 may include a minor filling fitting 89 configured to be located in, occupying and filling the minor removal fitting 96 in mating relationship therewith and defining a second debris seal 95 (shown in FIG. 2) between minor outer wall 93 (shown in FIG. 3) of minor filling fitting 89 and minor inner wall 91 of minor removal fitting 96. Referring to FIG. 3, removable cover 90 may include a spike projection 106 extending downward from cover bottom surface 83 at major axis 107.

Figure 4:
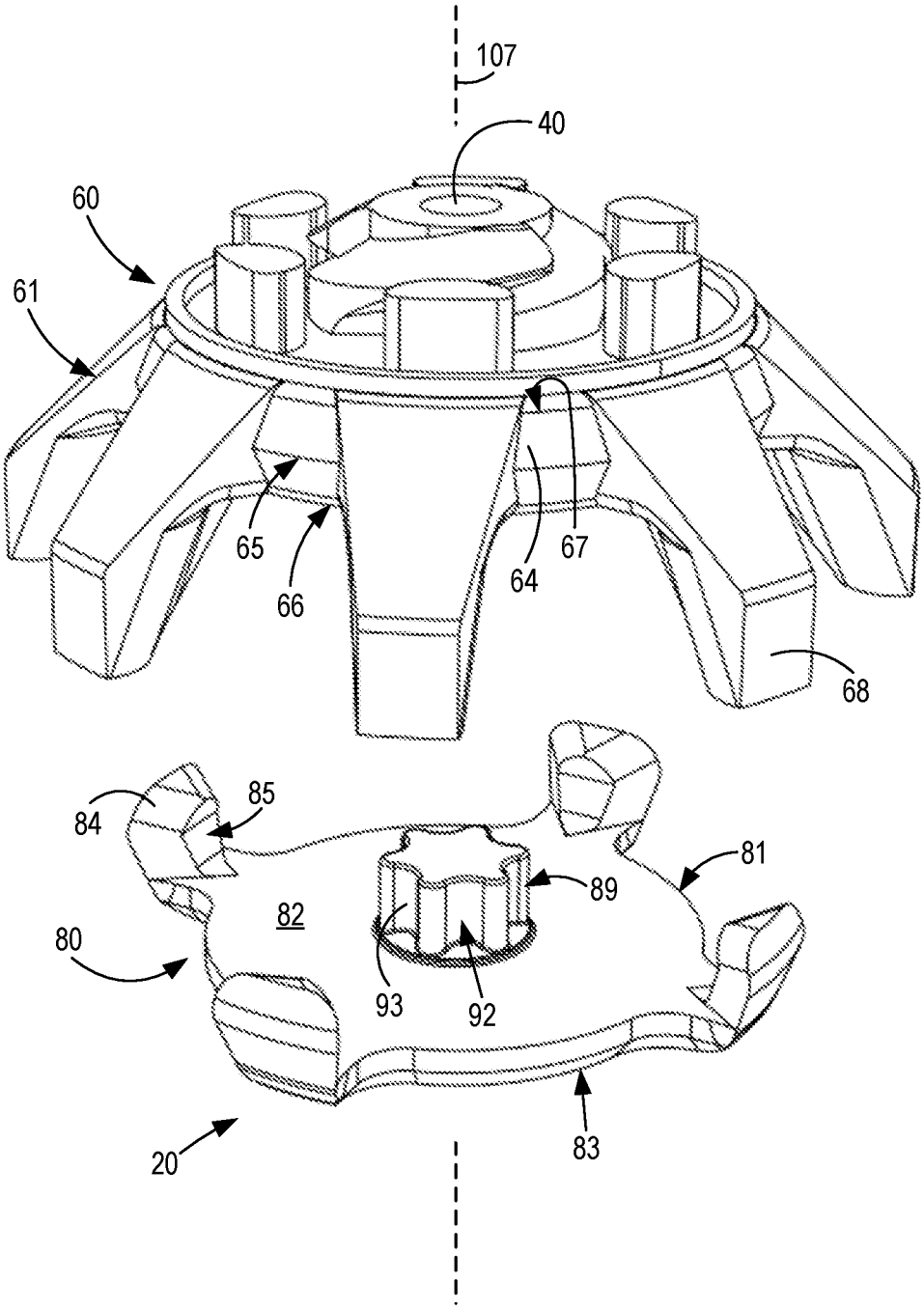
FIG. 4 is a raised perspective exploded assembly view of the traction cleat system in the first embodiment shown generally in FIG. 2.

FIG. 4 is a raised perspective exploded assembly view of the traction cleat system 20 in the first embodiment shown generally in FIG. 2. Major hub 60 includes hub body 64 having captured rim 65, hub bottom surface 66 and hub top surface 67. Removable cover 80 includes cover top surface 82 and cover bottom surface 83 opposite the cover top surface 82. Removable cover 80 includes a plurality of keeper arms 84 spaced about cover major periphery 81 and extending above cover top surface 82. Each keeper arm 84 includes capturing turn 85 located in registration with captured rim 65 of hub body periphery 61 to capture same and form the interference fit zone 87 (shown in FIG. 2) formed between each of the keeper arms 84 having capturing turn 85 in registration with corresponding captured rim 65 of the hub body periphery 61 of hub body 64.

Figure 5:
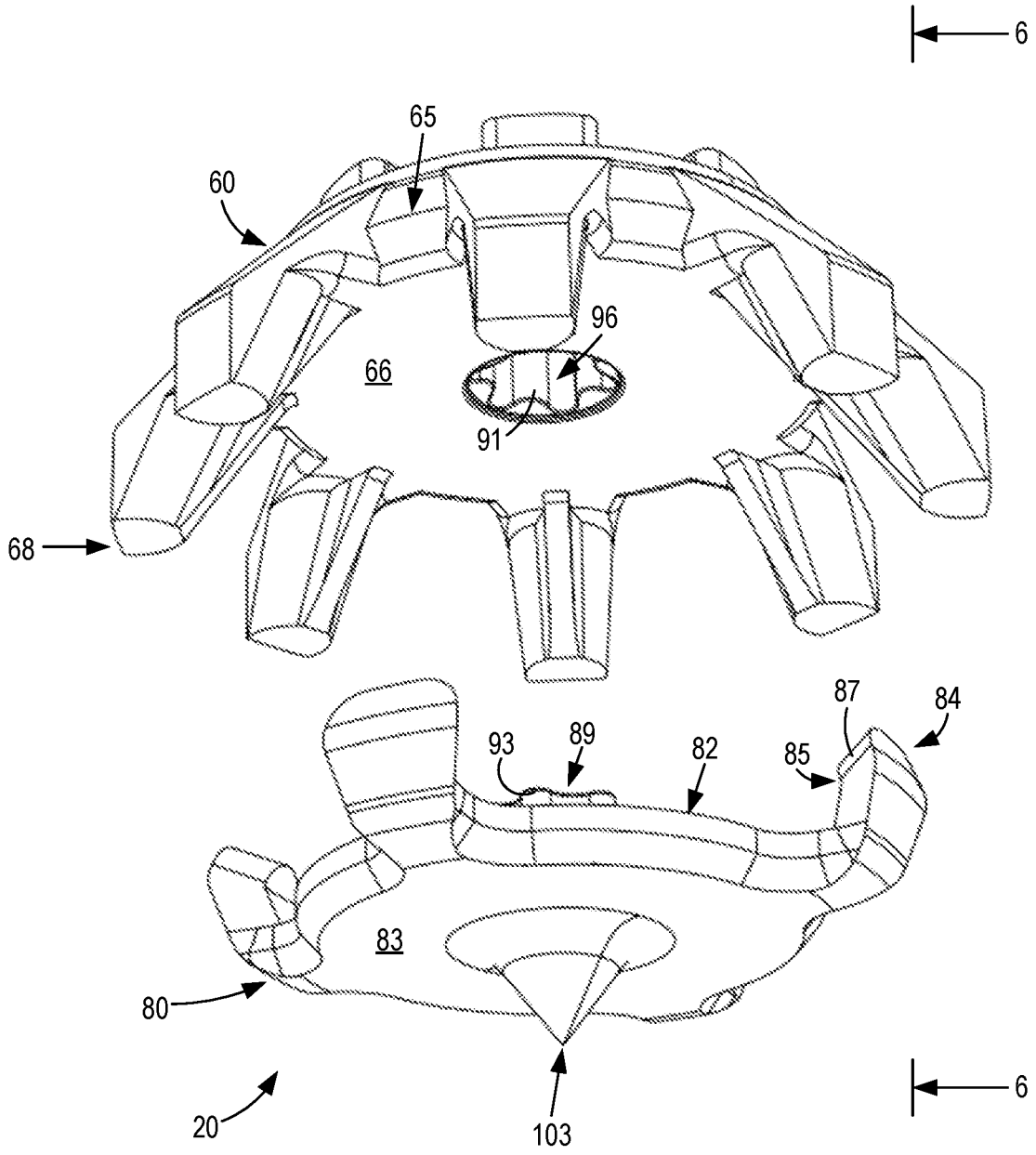
FIG. 5 is a low perspective exploded assembly view of the traction cleat system in the first embodiment shown in FIG. 4.

FIG. 5 is a low perspective exploded assembly view of the traction cleat system 20 in the first embodiment shown in FIG. 4.

Figure 6:
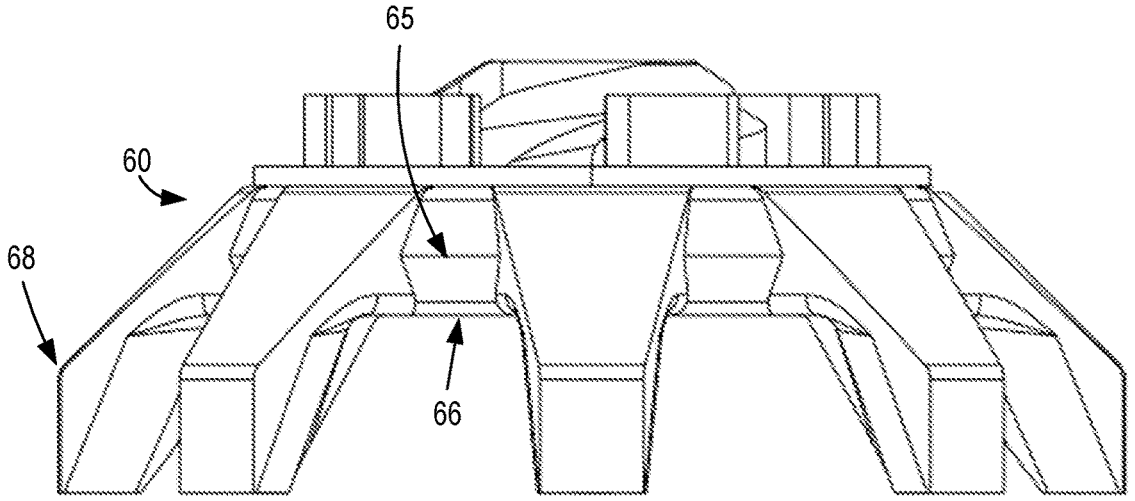
FIG. 6 is an exploded assembly side view taken generally along 6-6 in FIG. 5.
Figure 6:
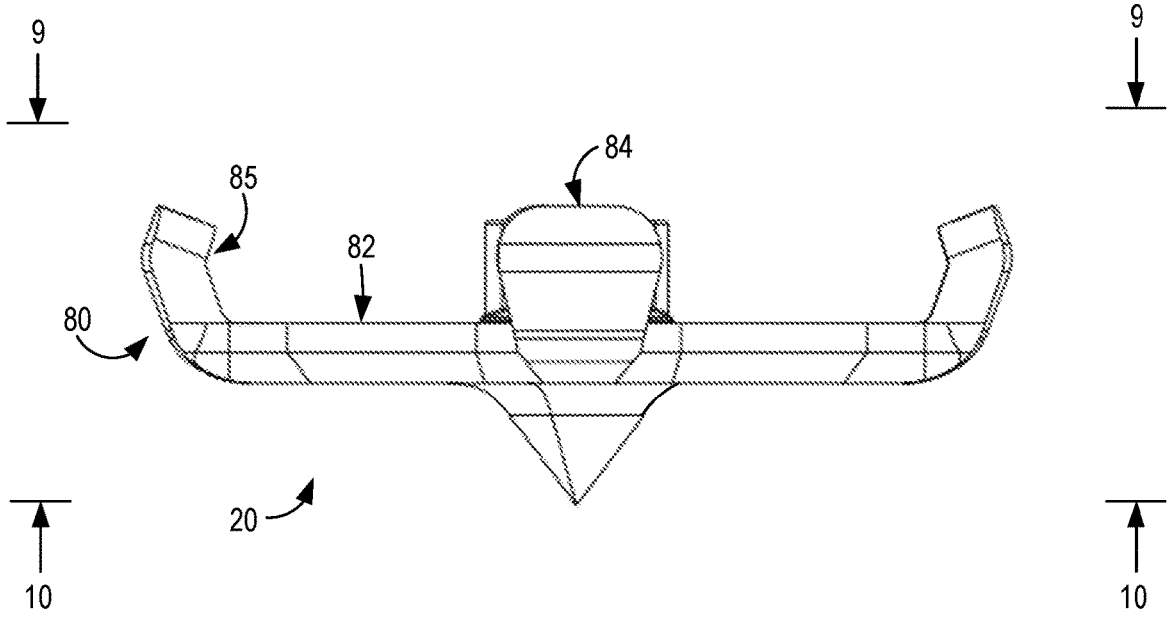

FIG. 6 is an exploded assembly side view taken generally along 6-6 in FIG. 5.

Figure 7:
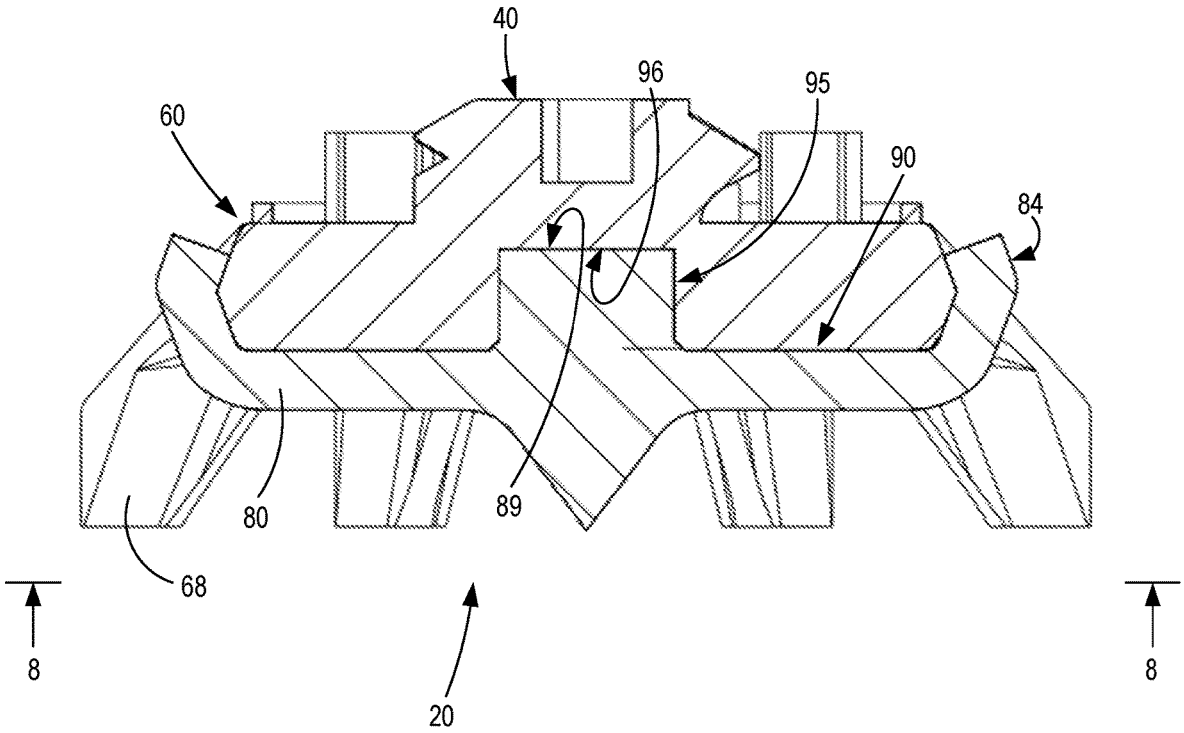
FIG. 7 is an enlarged partial cross-sectional view of the traction cleat system in the first embodiment shown generally in FIG. 2.

FIG. 7 is an enlarged partial cross-sectional view of the traction cleat system 20 in the first embodiment shown generally in FIG. 2. Cover periphery 109 of removable cover 80 is shown. Traction elements 68 are shown.

Figure 8:
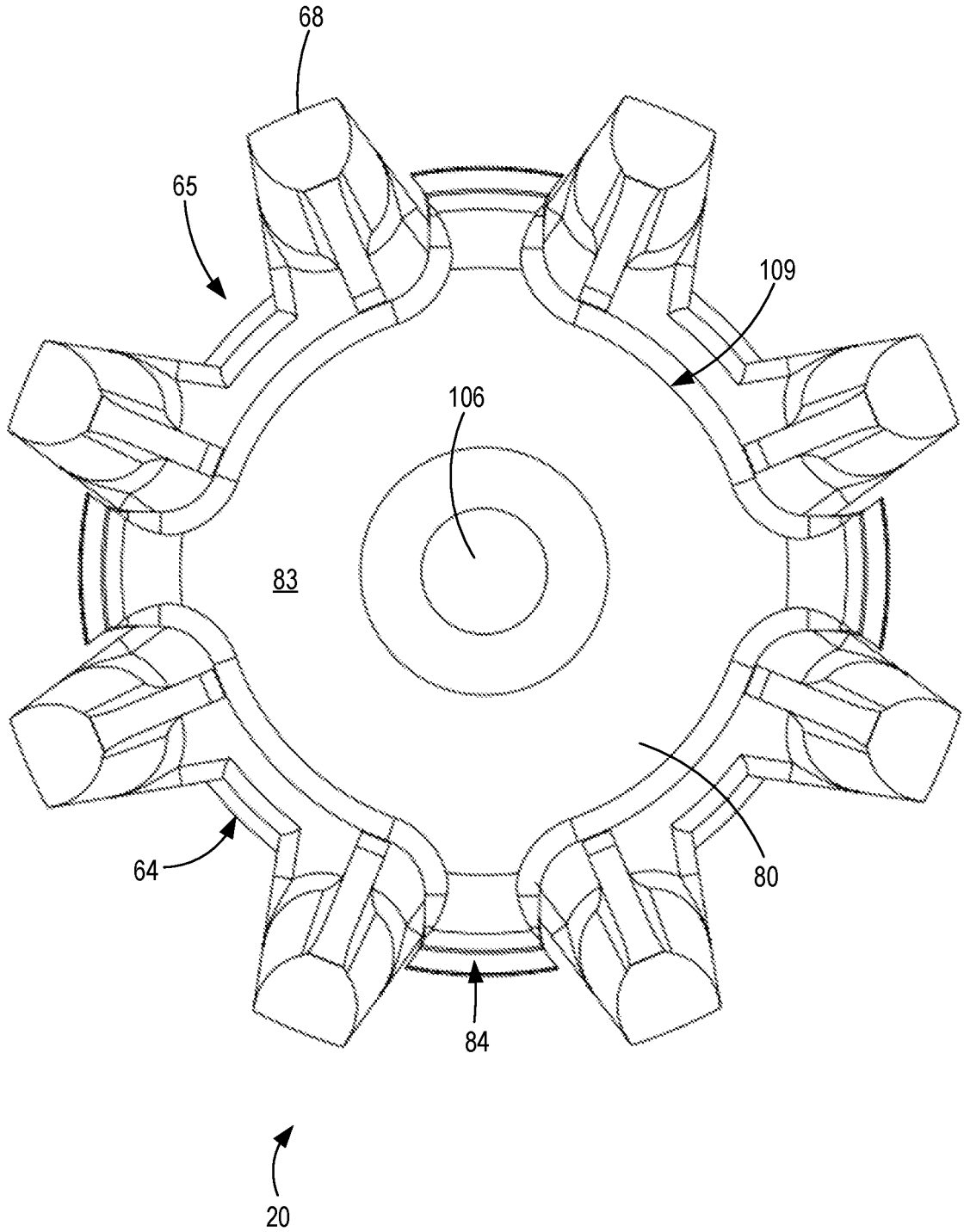
FIG. 8 is a bottom view taken generally along 8-8 in FIG. 7.

FIG. 8 is a bottom view taken generally along 8-8 in FIG. 7. Cover periphery 109 and keeper arms 84 of removable cover 80 is shown. Traction elements 68 of major hub 60 are shown to extend downward from hub body 64.

Figure 9:
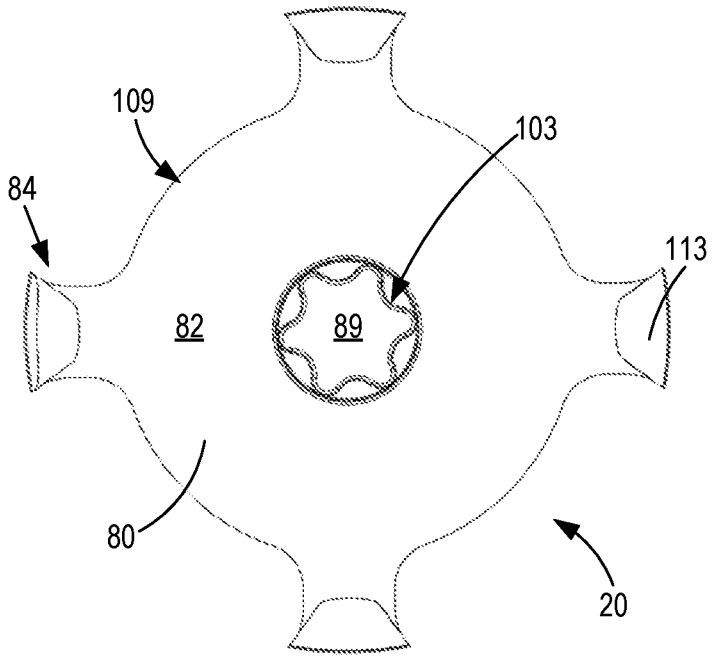
FIG. 9 is a partial isolation view taken generally along 9-9 in FIG. 6.

FIG. 9 is a partial isolation view taken generally along 9-9 in FIG. 6. Removable cover 90 includes cover periphery 109 and plurality of keeper arms 84 extending upward above cover top surface 82. Each of the keeper arms 84 has a distal end 113 spaced above the cover top surface 82. Minor filling fitting 89 having outer wall 103 projects upward from cover top surface 82.

Figure 10:
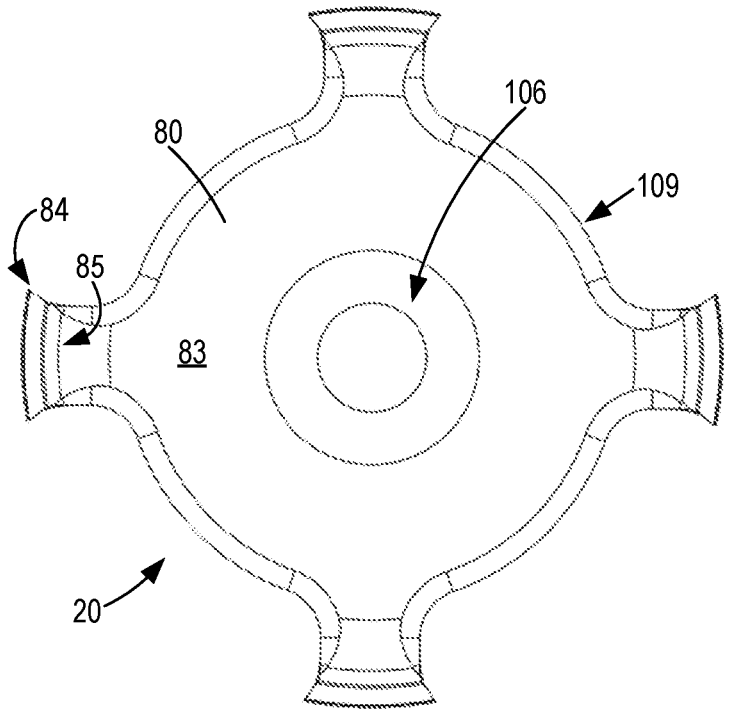
FIG. 10 is a partial isolation bottom view taken along 10-10 in FIG. 6.

FIG. 10 is a partial isolation bottom view of traction cleat system 20 taken along 10-10 in FIG. 6. Removable cover 80 includes cover bottom surface 83 and cover periphery 109 is shown. Spike projection 106 extends downward from cover bottom surface 83. Removable cover 80 includes the plurality of keeper arms 84 spaced about the cover periphery 109.

Figure 11:
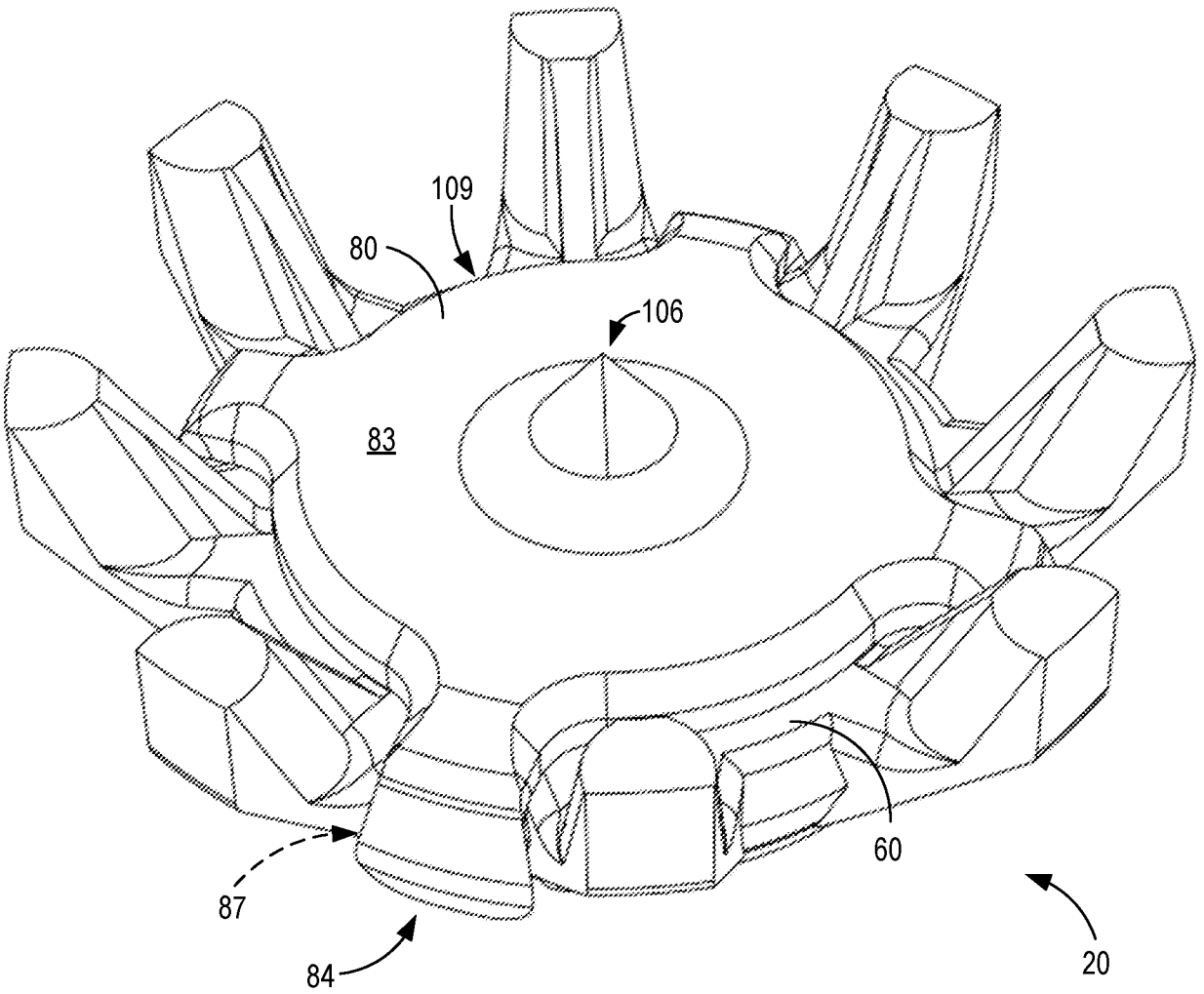
FIG. 11 is a low perspective view of the traction cleat system in the first embodiment shown generally in FIG. 8.

FIG. 11 is an inverted perspective view of the traction cleat system 20 in the first embodiment shown generally in FIG. 8. Removable cover 80 includes cover bottom surface 83 and cover periphery 109 is shown. Spike projection 106 extends downward from cover bottom surface 83. Removable cover 80 includes the plurality of keeper arms 84 spaced about the cover periphery 109.

Figure 12:
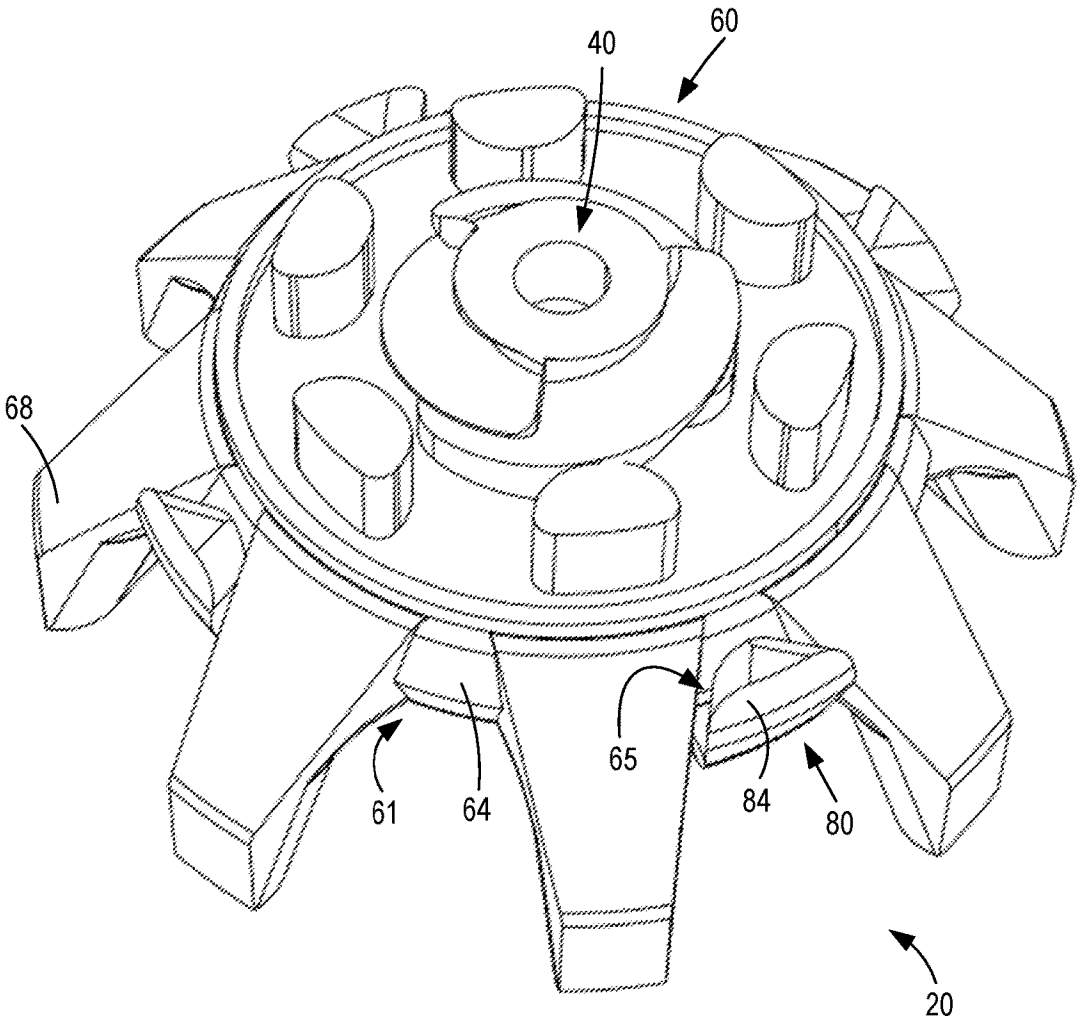
FIG. 12 is a raised perspective view of the traction cleat system in the first embodiment shown generally in FIG. 11.

FIG. 12 is a raised perspective view of the traction cleat system 20 in the first embodiment shown generally in FIG. 11. Major hub 60 include the plurality of traction elements 68 extending downward from the hub body periphery 61. Removable cover 80 includes the plurality of keeper arms 84 extending above captured rim 65 of hub body 64.

Figure 13:
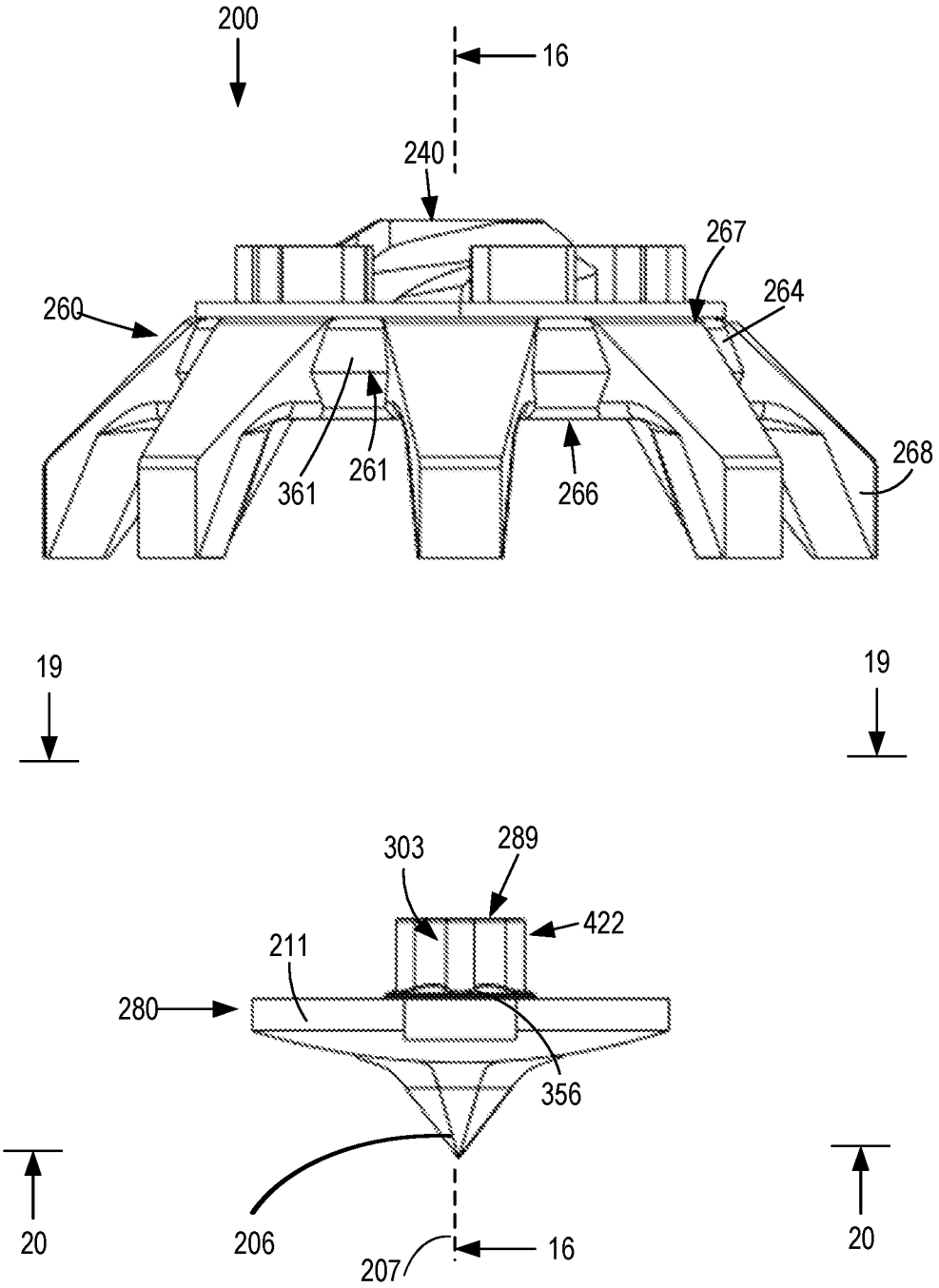
FIG. 13 is an exploded assembly side view of a traction cleat system in a second embodiment.

FIG. 13 is an exploded assembly side view of a traction cleat system 200 in a second embodiment. Traction cleat system 200 may be identical to traction cleat system 20 illustrated in FIGS. 1-12 and described elsewhere in this disclosure in reference to FIGS. 1-12, except as traction cleat system 200 may be otherwise described herein in reference to FIGS. 13-23 illustrating traction cleat system 200. As shown in FIG. 13, traction cleat system 200 includes cover 280. It is shown in FIG. 13 that cover 280 of illustrated traction cleat system 200 differs from cover 80 of traction system 20 shown in FIGS. 1-12 in that cover 280 does not include, and omits, a plurality of keeper arms (keeper arms 84 being shown in FIGS. 1-12) that are included in cover 80 of traction cleat system 20. As shown in FIG. 13, traction cleat system 200 may include central spike projection 206 formed on cover bottom surface 283 of removable cover 280.

Referring to FIG. 13, traction cleat system 200 may include major hub 260 joined to connection stem 240. The major hub 260 may include hub body 264 having a hub top surface 267 adjacent the connection stem 240. Hub body 264 includes a hub bottom surface 266 opposite the hub top surface 267. The hub body 264 has a body periphery 261 spaced apart from a major axis 207 in the radial direction. The hub bottom surface 266 extends perpendicular to the major axis 207.

As shown in FIG. 13, major hub 260 includes a plurality of traction elements 268 extending downward from the hub body 264 at the body periphery 261. The plurality of traction elements 268 are spaced about the body periphery 261, such that the body periphery 261 is subdivided by the plurality of traction elements 268 spaced thereabout and includes a plurality of body peripheral segments 361 each defined between adjacent of the plurality of traction elements 268.

Figure 15:
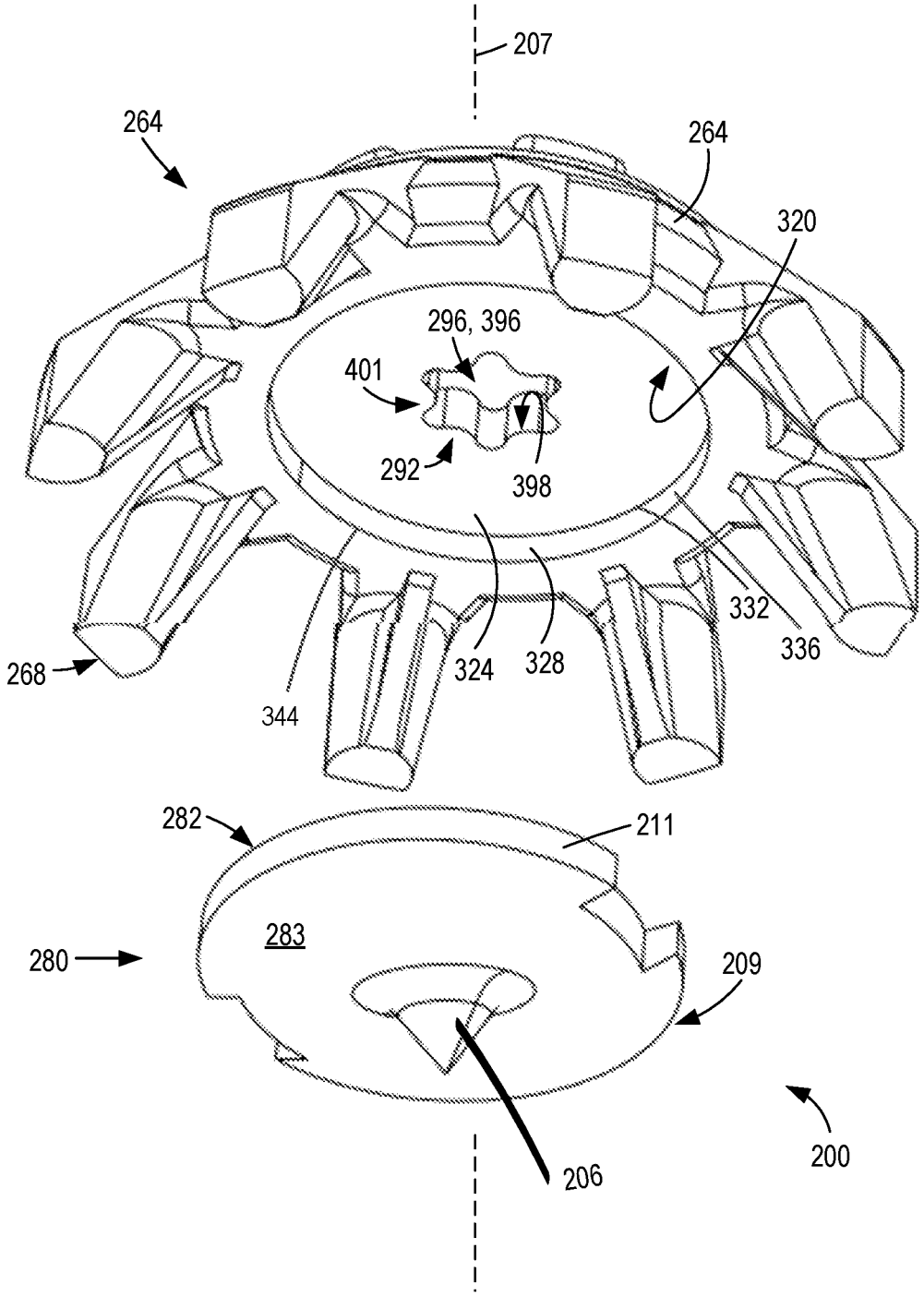
FIG. 15 is a low perspective exploded assembly view of the traction cleat system in the second embodiment shown generally in FIG. 14.

Referring to FIG. 15, a major recess 320 is defined in the hub bottom surface 266. The major recess 320 is configured to receive removable cover 280 when installed therein in an interference fit relationship. Major recess 320 is symmetrical about major axis 207 and has a recess periphery defined by continuous major end wall 324. Major end wall 324 extends parallel to the hub bottom surface 266 in spaced relationship to the hub bottom surface 266. The major end wall 324 intersects a continuous major sidewall 328 along a continuous rear corner joint 332. Rear corner joint 332 is spaced apart from the major axis 207 in the radial direction. The major sidewall 328 is perpendicular to the major end wall 324 and spaced apart from the major axis 207 in the radial direction. The major sidewall 328 extends downward from the rear corner joint 332 to the hub bottom surface 266 in spaced relationship to the major axis 207. Major sidewall 328 intersects the hub bottom surface 266 at a continuous outer edge 336 to define an open mouth of the major recess 320 opposite the major end wall 324. The open mouth of major recess 320 is configured to receive the removable cover 280. Major sidewall 328 is substantially coextensive with a cover periphery 209 of the removable cover 280 to engage the removable cover 280 at the cover periphery 209 in an interference fit defining a continuous interference fit zone 344. The interference fit holds the removable cover 280 in a fixed position in the major recess 320 to define at least one first debris seal 290 providing an enclosed portion 346 of the major recess 320. The enclosed portion 346 defines a clean zone 292 of the major recess 320. The clean zone 292 defined by enclosed portion 346 is isolated from communication with an external environment by the at least one first debris seal 290 formed by mated sealing engagement of the removable cover 280 with the major sidewall 328. Referring to FIG. 15, in the embodiment shown therein, removable cover 280 includes continuous outer wall 348 extending about the cover periphery 209. The continuous outer wall 348 also extends from intersection with the cover top surface 282 to intersection with the cover bottom surface 283 in parallel relation to the major axis 207. The cover periphery 209 defined by the outer wall 348 is substantially identical to the recess periphery 267 defined by major wall 328 and sized to provide the interference fit in a continuous interference fit zone 344 formed between the cover periphery 209 of removable cover 280 at the outer wall 348 thereof and the major wall 328 defining the recess periphery 267 of the major recess 320. The interference fit in the interference fit zone 344 thus provides positive engagement holding the removable cover 280 in a fixed position and in mated sealing engagement with the major wall 328 of the major recess 320 forming the at least one first debris seal 290. The mated sealing engagement defining the interference fit in interference fit zone 344 holds the removable cover 280 in a fixed position in the major recess 320 to define enclosed portion 346 which defines clean zone 292 of the major recess 320. The enclosed portion 346 is isolated from communication with an external environment by mated sealing engagement of the removable cover 280 with the major sidewall 328.

Clean zone 292 is defined inside at least one first debris seal 290 in isolated, clean condition with the at least one debris seal 290 preventing open communication of particulate debris from the external environment to the clean zone 292. Traction cleat system 200 may include a minor removal fitting 296 disposed in the clean zone 292 in isolated, clean condition with the at least one debris seal 290 preventing open communication of particulate debris from the external environment to the minor removal fitting 296 in clean zone 292. As used herein, the isolated, clean condition includes the clean zone 292 and minor removal fitting 296 disposed therein being maintained in clean condition that is isolated and free from entry of particulate debris, including compacted debris, from the external environment during ordinary use of the athletic shoe. The clean condition may continue until it is desired to remove the removable cover 280 from positive engagement with the hub body 264 to access and manipulate the minor removal fitting 296 maintained in clean condition free of debris, to remove the traction cleat system 200 from the athletic shoe 52 and replace it with a new one.

Traction cleat system 200 may include the minor removal fitting 296, which may comprise minor recess fitting 396, defined in the major end wall 324. The minor recess fitting 396 may have a minor recess axis coextensive with the major axis 207 and a minor recess periphery 398 spaced apart in the radial direction from the major axis 207. The minor recess fitting 396 may have a minor recess cross-sectional shape 401 defined by the minor recess periphery 398. The minor recess fitting 396 may be in open communication with the enclosed portion 346 of the major recess 320 with the minor recess fitting 396 isolated from communication with the external environment by the at least one debris seal 290 preventing open communication of particulate debris from the external environment to the comprising minor recess fitting 396 in clean zone 292 provided by the mated sealing engagement of the cover periphery 209 defined by substantially continuous major outer wall 211 of removable cover 280 with the major sidewall 328.

Figure 21:
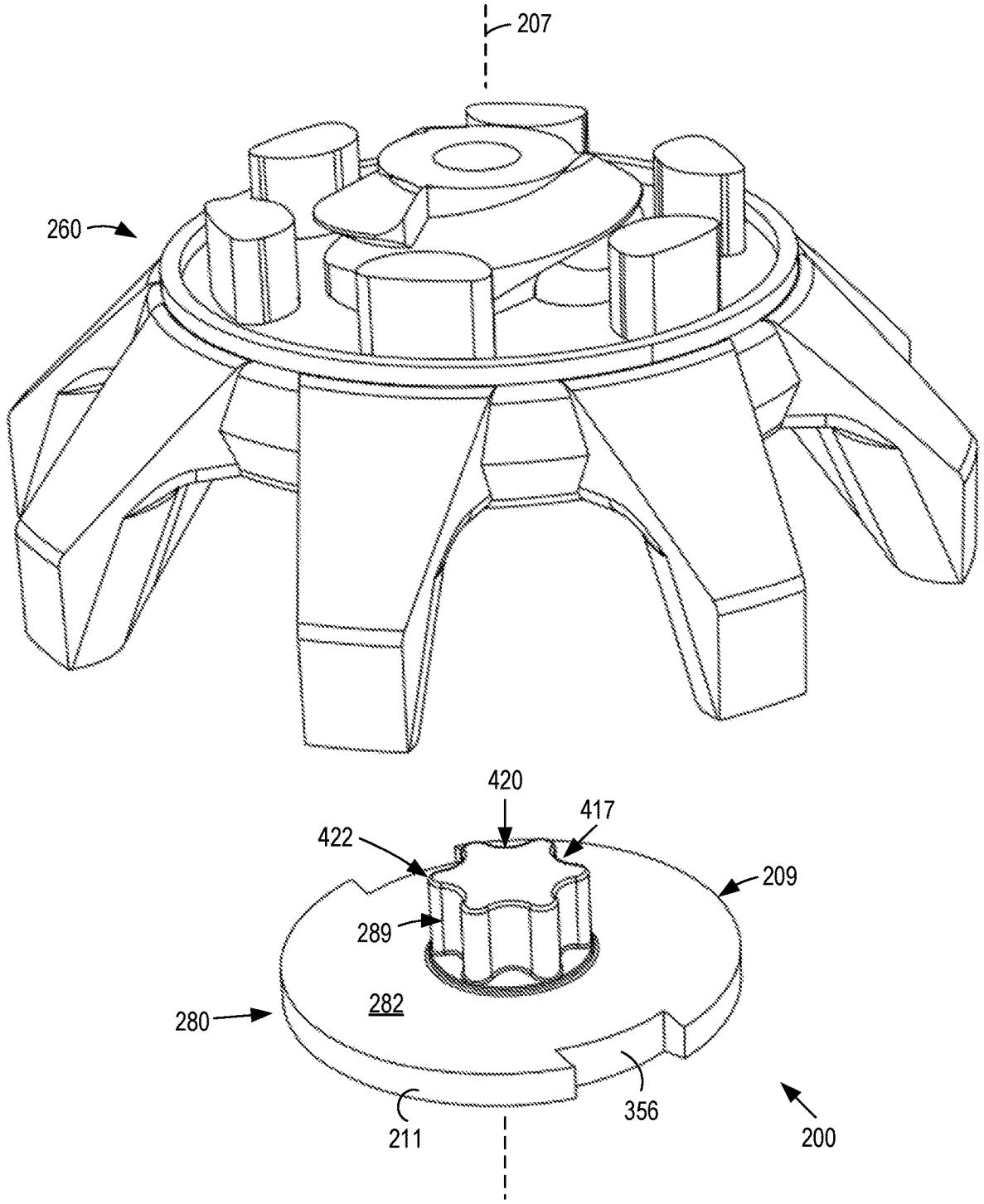
FIG. 21 is a raised perspective exploded assembly view of the traction cleat system in the second embodiment shown generally in FIG. 14.

Referring to FIG. 21, traction cleat system 200 may include removable cover 280 having cover periphery 209 defined by substantially continuous major outer wall 211. Removable cover 280 may include cover top surface 282 spaced from cover bottom surface 283 and disposed in opposition to the cover bottom surface 283 (FIG. 15). Referring to FIG. 21, traction cleat system 200 may include removable cover 280 having a minor filling projection 289 extending upward from the cover top surface 282. The minor filling projection 289 may have a minor projection axis coextensive with the major axis 207. Minor filling projection 289 may have a projection minor periphery 417 spaced apart in the radial direction from the major axis 207. The minor filling projection 289 may have a minor projection cross-sectional shape 420 identical to the minor recess cross-sectional shape 401 (shown in FIG. 15), which may be star-shaped. Referring to FIG. 21, the removable cover 280 may have a cover major periphery 209 defined by continuous major outer wall 211 spaced apart from the major axis 207. The cover major outer wall 211 is parallel to the major axis 207 and may extend from the cover top surface 282 to the cover cover bottom surface 283. A central spike projection 206 may be formed on cover bottom surface 283 of removable cover 280.

Figure 14:
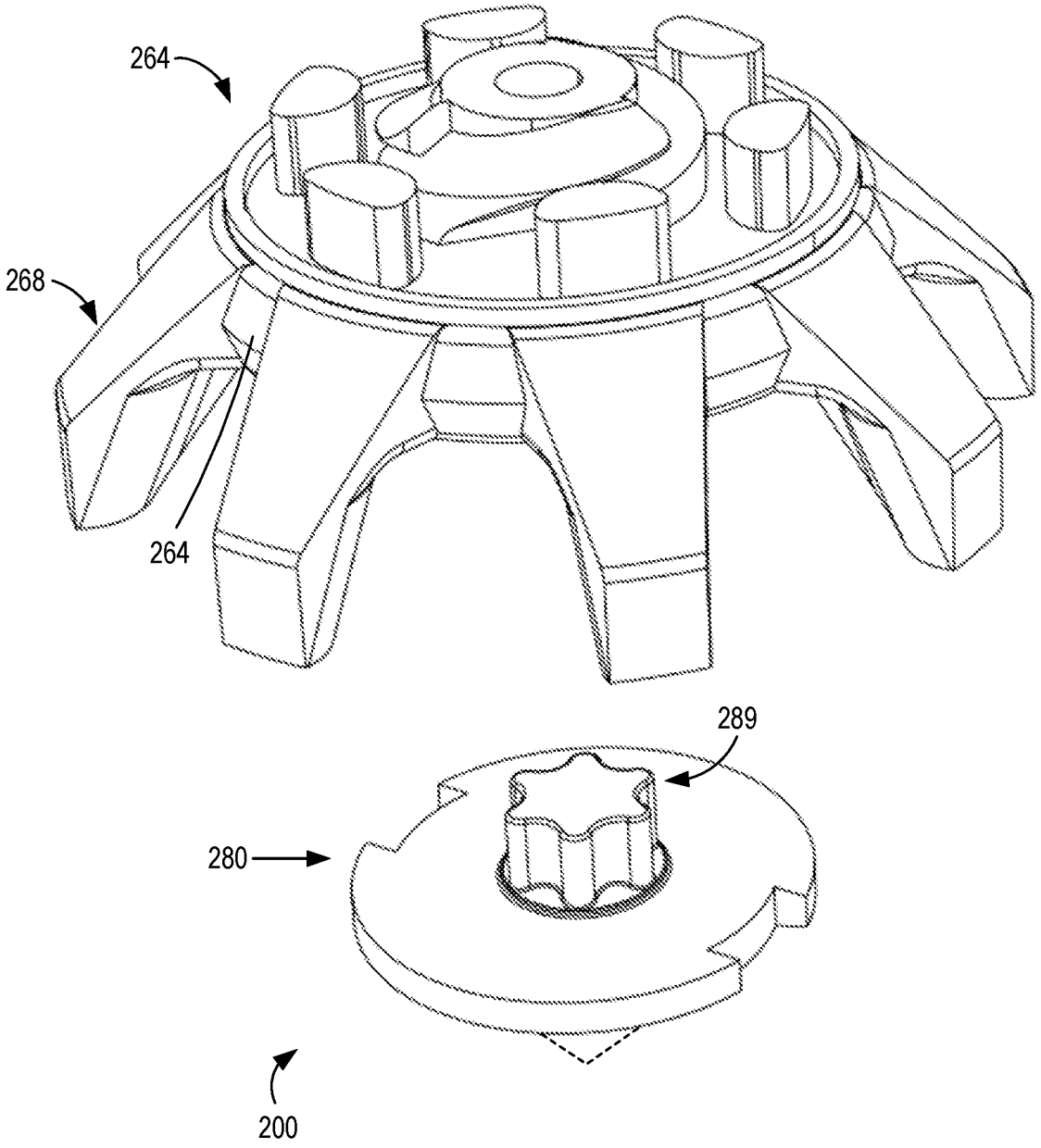
FIG. 14 is a raised perspective exploded assembly view of the traction cleat system in the second embodiment shown generally in FIG. 13.

FIG. 14 is a raised perspective exploded assembly view of the traction cleat system 200 in the second embodiment shown generally in FIG. 13. Traction cleat system 200 includes removable cover 280 having minor filling projection 289.

FIG. 15 is a low perspective exploded assembly view of the traction cleat system 200 in the second embodiment shown generally in FIG. 14. Hub body 264 may include minor removal fitting 296 comprising a minor recess fitting 396 defined in clean zone 292 of recess 320.

Figure 16:
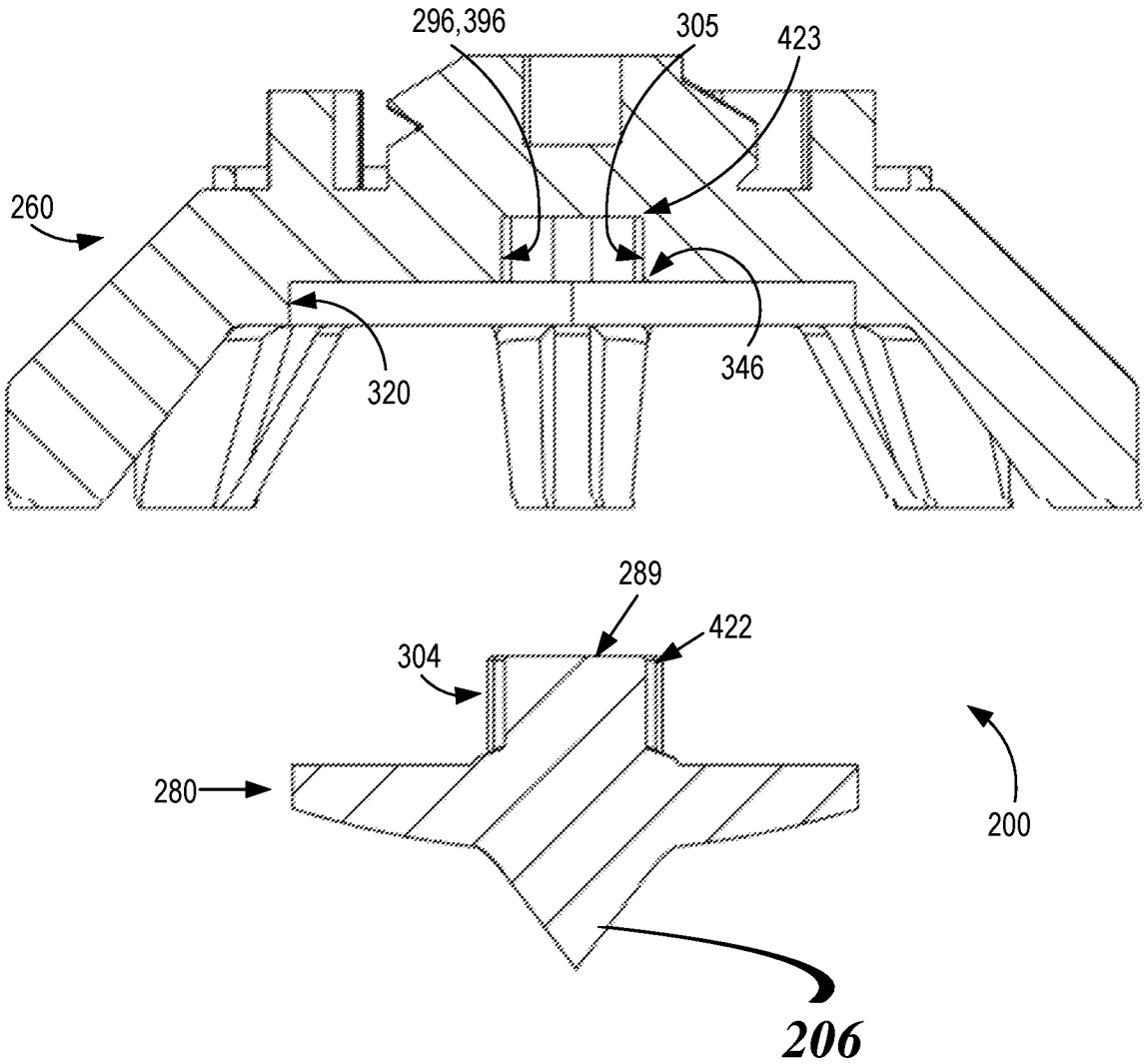
FIG. 16 is a cross-sectional exploded assembly view of the traction cleat system in the second embodiment, taken generally along 16-16 in FIG. 13.
Figure 17:
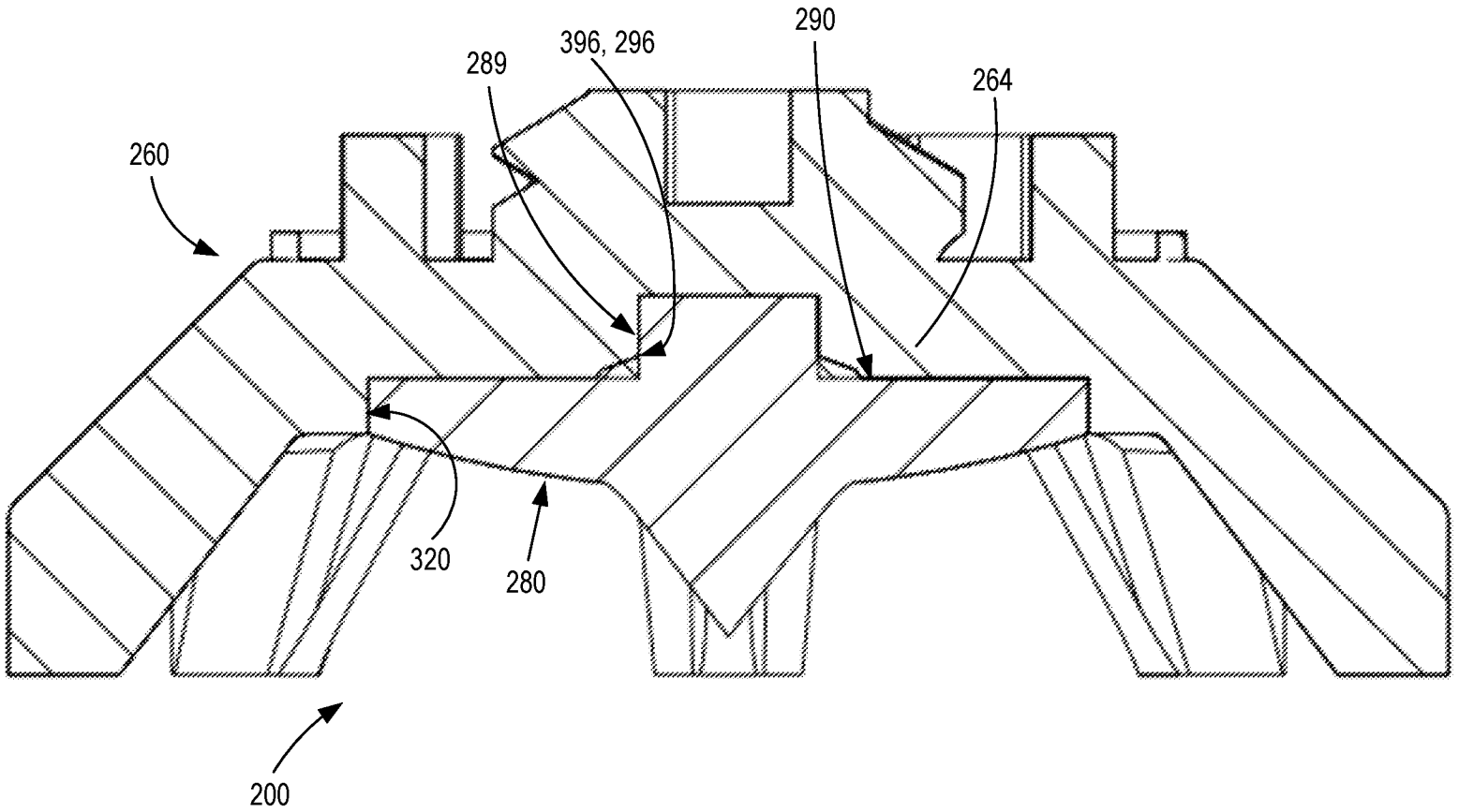
FIG. 17 is a cross-sectional assembly view of the traction cleat system in the second embodiment shown generally in FIG. 16.
Figure 18:
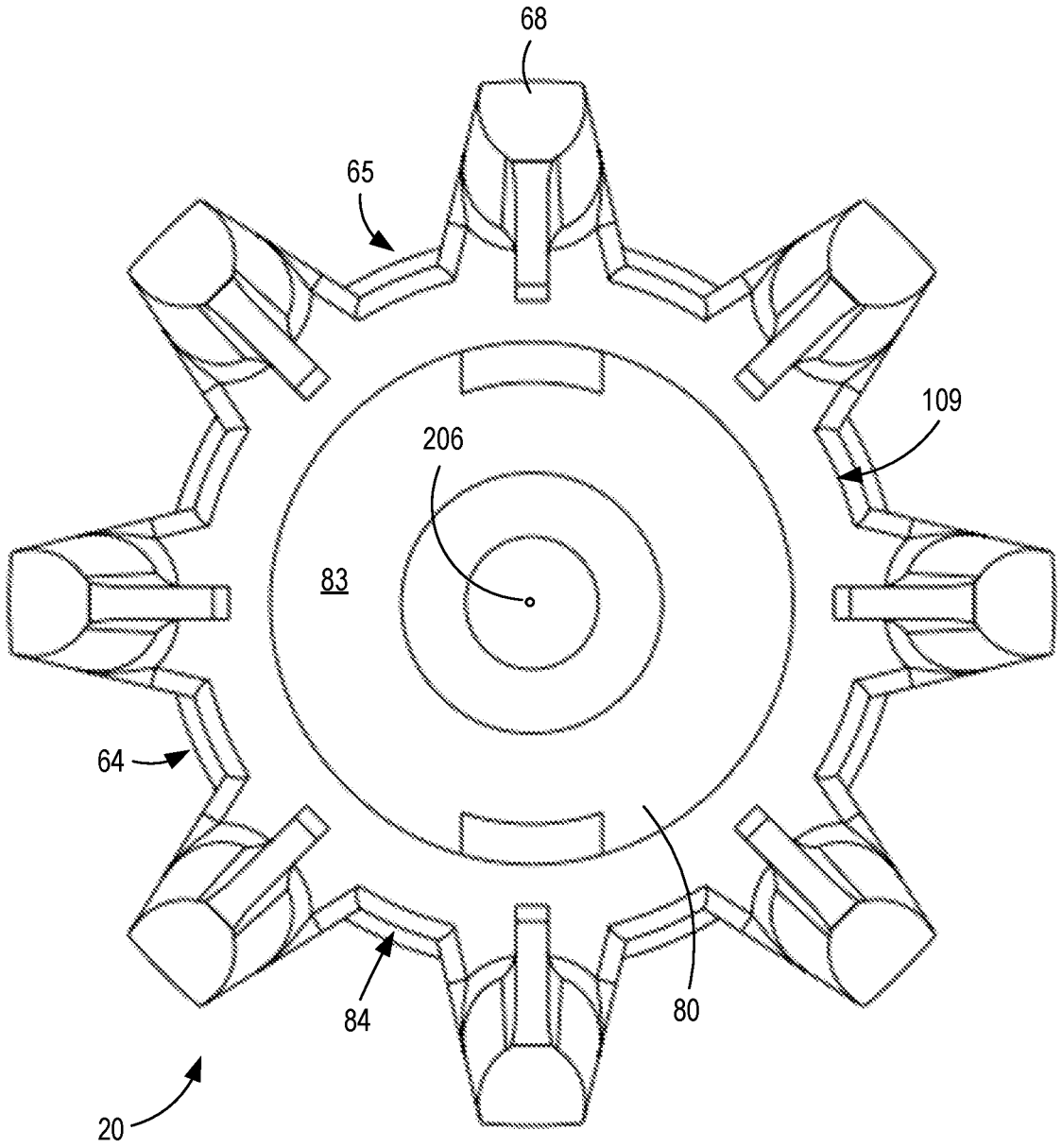
FIG. 18 is a bottom assembly view of the traction cleat system in the second embodiment shown generally in FIG. 13.

FIG. 16 is a cross-sectional exploded assembly view of the traction cleat system 200 in the second embodiment, taken generally along 16-16 in FIG. 13. Removable cover 280 may include minor filling projection 289 having an identical minor projection periphery 422 identical to a minor recess periphery 423 of minor removal fitting 296 comprising a minor recess fitting 396 defined in recess 320 of hub body 260, for mated engagement of minor projection surface 304 of minor filling projection 289 with minor inner surface 305 of minor recess fitting 396 to block entry of particulate debris into minor recess fitting 396 and thus maintain minor recess fitting 396 in ready, operable and clean condition. FIG. 17 is a cross-sectional assembly view of the traction cleat system 200 in the second embodiment shown generally in FIG. 16. Traction cleat system 200 may include removable cover 280 in mated sealing engagement with hub body 264 defining at least one first debris seal 290 to provide clean zone 292 having minor removal fitting 296 disposed therein. The FIG. 18 is a bottom assembly view of the traction cleat system 200 in the second embodiment shown generally in FIG. 13. Removable cover 280 may include a pry slot 356 defined in major outer wall 211. A flat end of a manual pry tool (not shown) may be inserted into pry slot 356 for manually prying loose removable cover 280 from mated sealing engagement with hub body 264, for removing the removable cover 280 to gain access to the minor recess fitting 396 for removing and replacing traction cleat system 200 or replacing at least the major hub 260 including hub body 264 and the plurality of traction elements 268 thereof, when the plurality of traction elements 268 become worn down.

Figure 19:
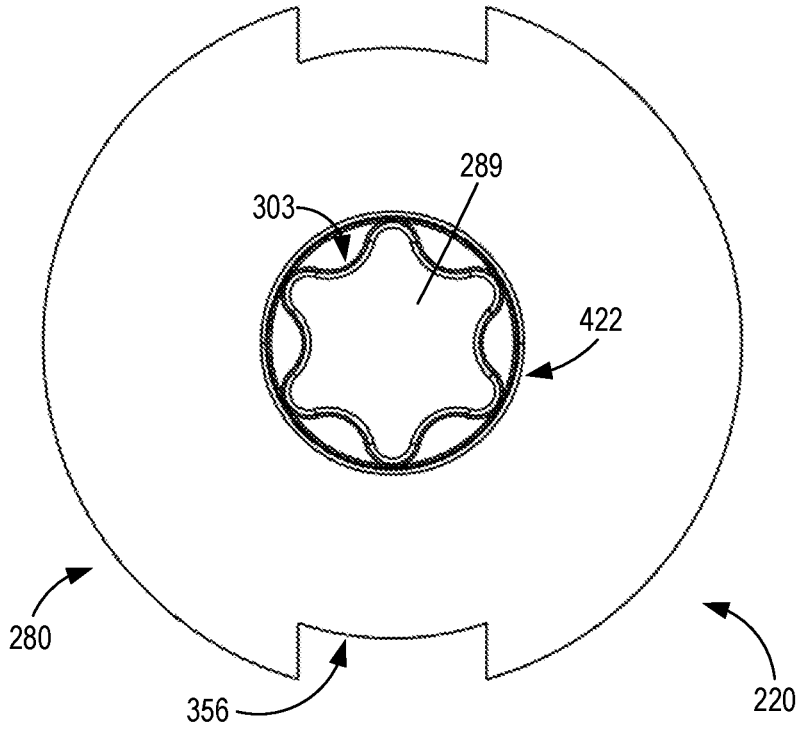
FIG. 19 is a partial isolation view taken generally along 19-19 in FIG. 13.
Figure 20:
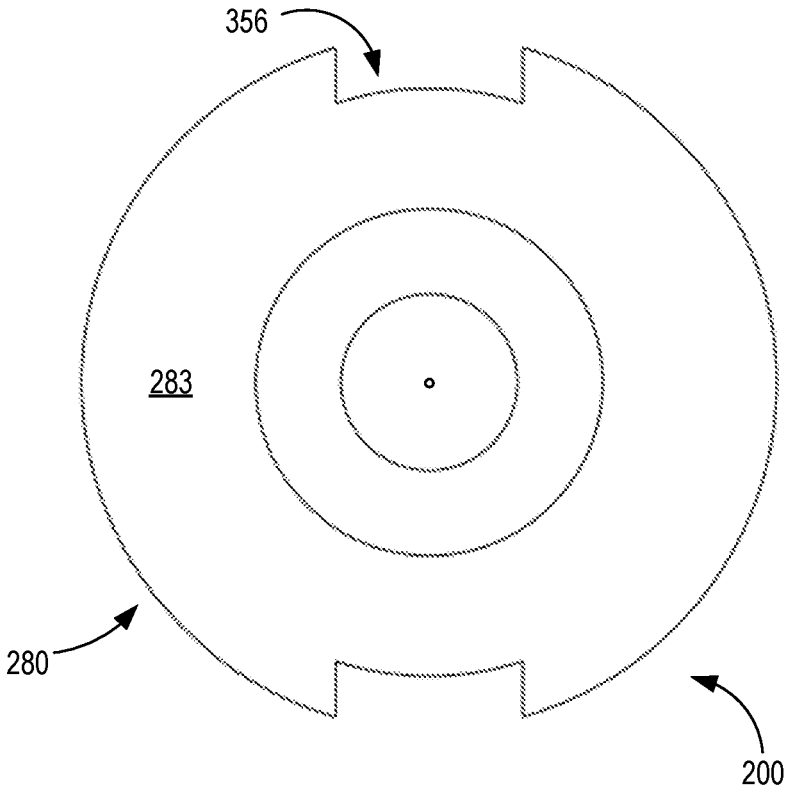
FIG. 20 is a partial isolation view taken generally along 20-20 in FIG. 13.
Figure 22:
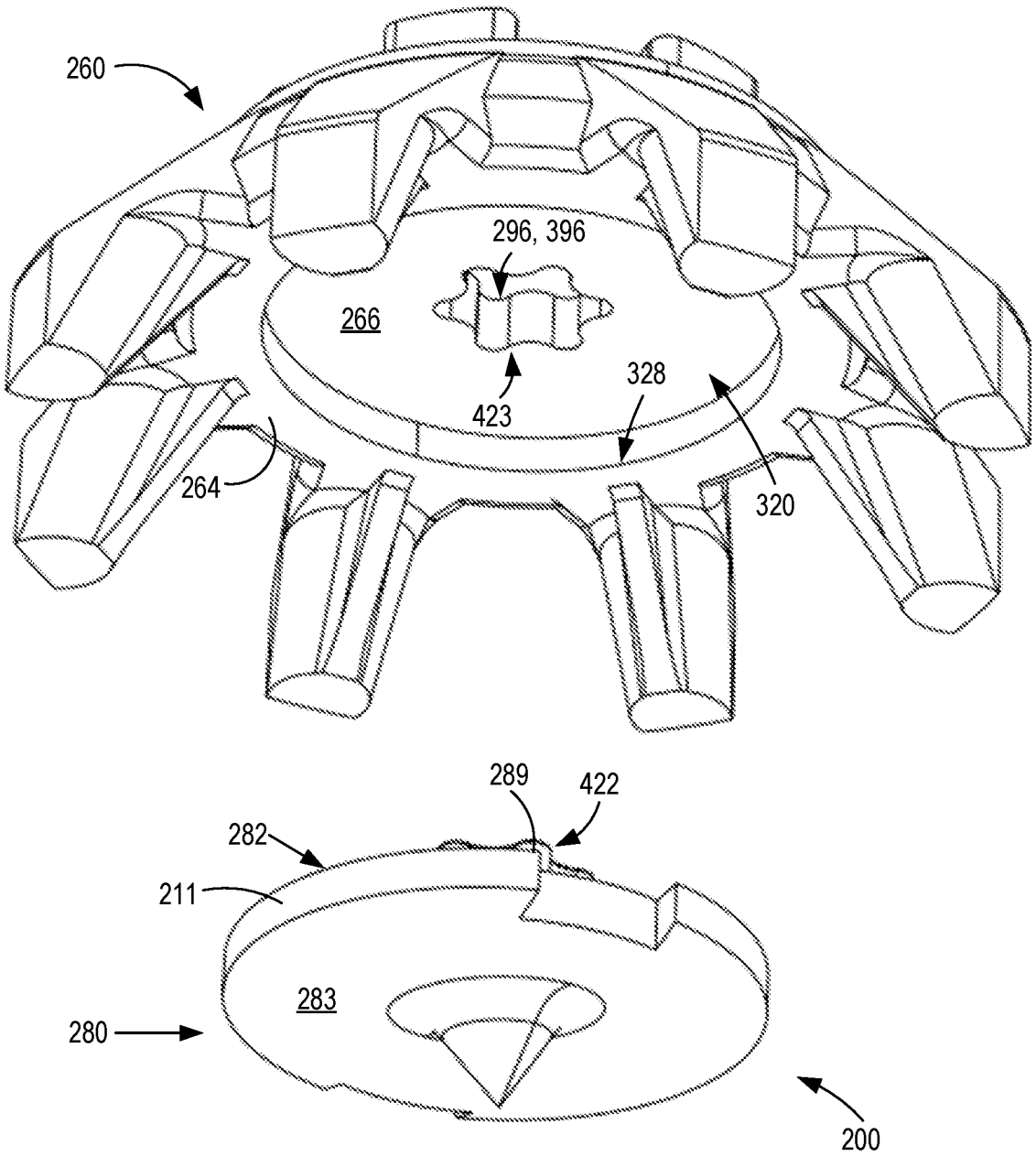
FIG. 22 is a low perspective exploded assembly view of the traction cleat system in the second embodiment shown generally in FIG. 15.
Figure 23:
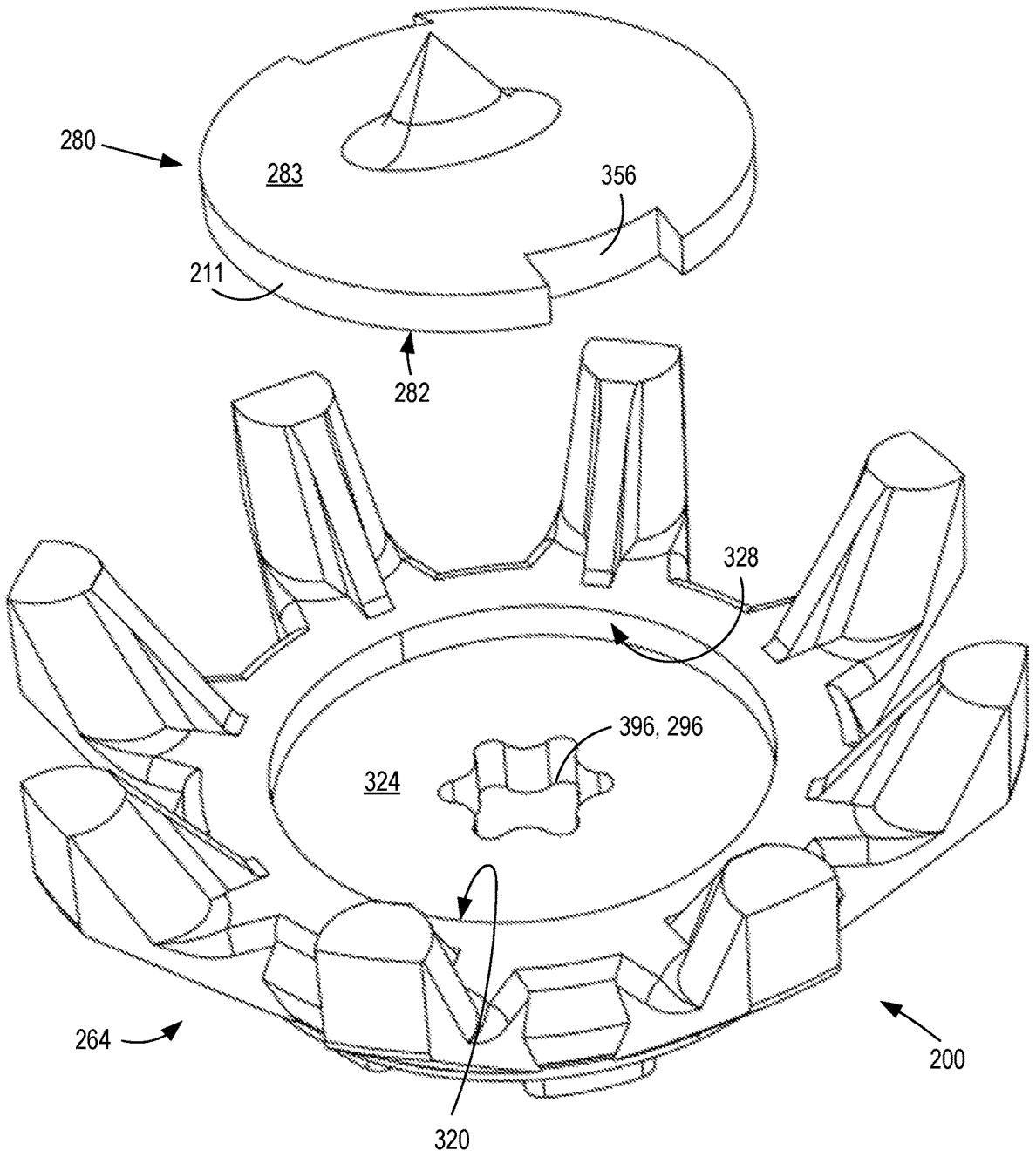
FIG. 23 is an inverted perspective exploded assembly view of the traction cleat system in the second embodiment shown generally in FIG. 22.

FIG. 19 is a partial isolation view of traction cleat system 200 taken generally along 19-19 in FIG. 13. Minor filling projection 289 may have a star-shaped minor projection periphery 422 for mating engagement with an identical minor recess periphery 423 (see FIG. 22). FIG. 20 is a partial isolation view of traction cleat system 200 taken generally along 20-20 in FIG. 13. FIG. 21 is a raised perspective exploded assembly view of the traction cleat system 200 in the second embodiment shown generally in FIG. 14. FIG. 22 is a low perspective exploded assembly view of the traction cleat system 200 in the second embodiment shown generally in FIG. 15. FIG. 23 is an inverted low perspective exploded assembly view of the traction cleat system in the second embodiment shown generally in FIG. 22. Hub bottom surface 266 includes major recess 320 defined therein.

A traction cleat system for an athletic shoe may include a removal fitting located in clean zone defined by at least one debris seal, such that the removal fitting and clean zone are maintained in clean condition that is free of compacted debris during ordinary use of the athletic shoe, until it is desired to access the removal fitting to remove the traction cleat system from the athletic shoe.

Apparatus, methods and systems according to embodiments of the disclosure are described. Although specific embodiments are illustrated and described herein, it will be appreciated by those of ordinary skill in the art that any arrangement which is calculated to achieve the same purposes can be substituted for the specific embodiments shown. This application is intended to cover any adaptations or variations of the embodiments and disclosure. For example, although described in terminology and terms common to the field of art, exemplary embodiments, systems, methods and apparatus described herein, one of ordinary skill in the art will appreciate that implementations can be made for other fields of art, systems, apparatus or methods that provide the required functions. The invention should therefore not be limited by the above described embodiment, method, and examples, but by all embodiments and methods within the scope and spirit of the invention.

In particular, one of ordinary skill in the art will readily appreciate that the names of the methods and apparatus are not intended to limit embodiments or the disclosure. Furthermore, additional methods, steps, and apparatus can be added to the components, functions can be rearranged among the components, and new components to correspond to future enhancements and physical devices used in embodiments can be introduced without departing from the scope of embodiments and the disclosure. One of skill in the art will readily recognize that embodiments are applicable to future systems, future apparatus, future methods, and different materials.

All methods described herein can be performed in a suitable order unless otherwise indicated herein or otherwise clearly contradicted by context. The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

Terminology used in the present disclosure is intended to include all environments and alternate technologies that provide the same functionality described herein.

What is claimed is:

1. A traction cleat assembly for a golf shoe, the golf shoe including an outsole having defined therein a plurality of cleat receptacles, said traction cleat assembly comprising:

a connection stem configured to be received in one of the plurality of cleat receptacles to affix the traction cleat assembly to the outsole;

a major hub joined to the connection stem, the major hub comprising:

a hub body having a hub top surface adjacent the connection stem, opposite the hub top surface the hub body having a hub bottom surface, the hub body having a body periphery defined by intersection of the hub top surface with the hub bottom surface, the hub periphery spaced apart from a hub major axis in the radial direction, the hub bottom surface perpendicular to the hub major axis;

a plurality of traction elements extending downward from the hub body at the body periphery, the plurality of traction elements spaced about the body periphery, the body periphery subdivided by the plurality of traction elements, the body periphery comprising a plurality of body peripheral segments each defined between adjacent of the plurality of traction elements;

a major recess defined in the hub bottom surface, the major recess receiving a removable cover, the major recess having a major axis coextensive with the hub major axis, the major recess having a major end wall parallel to the hub bottom surface in spaced relationship to the hub bottom surface, the major end wall intersecting a major sidewall along a rear corner joint spaced apart from the major axis in the radial direction, the major sidewall perpendicular to the major end wall, the major sidewall spaced apart from the major axis in the radial direction, the major sidewall extending from the rear corner joint to the hub bottom surface in spaced relationship to the major axis, the major sidewall intersecting the hub bottom surface at a continuous outer edge to define an open mouth opposite the major end wall, the open mouth configured to receive the removable cover, the major sidewall substantially coextensive with a cover periphery of the removable cover to engage the removable cover at the cover periphery in an interference fit holding the removable cover in a fixed position in the major recess to define an enclosed portion of the major recess, the enclosed portion isolated from communication with an external environment by mated sealing engagement of the removable cover with the major sidewall;

a minor recess defined in the major end wall, the minor recess having a minor recess axis coextensive with the major axis, the minor recess having a minor recess periphery spaced apart in the radial direction from the minor recess axis, the minor recess having a minor recess cross-sectional shape defined by the minor recess periphery, the minor recess in open communication with the enclosed portion of the major recess, the minor recess terminating intermediate the major end wall and the hub top surface in spaced relationship to the hub top surface, the minor recess isolated from communication with the external environment by the mated sealing engagement of the removable cover with the major sidewall;

the removable cover comprising:

a one-piece structure having a cover top surface spaced from a cover bottom surface of said one-piece structure, the cover top surface disposed in opposition to the cover bottom surface;

a minor filling projection extending upward from the cover top surface, the minor filling projection terminating intermediate the major end wall and the hub top surface in spaced relationship to the major end wall and in spaced relationship to the hub top surface, the minor filling projection having a minor projection axis coextensive with the major axis, the minor filling projection having a projection minor periphery spaced apart in the radial direction from the minor projection axis, the minor filling projection having a minor projection cross-sectional shape identical to the minor recess cross-sectional shape;

the removable cover having a cover major periphery defined by a continuous cover outer wall spaced apart from the major axis, the cover outer wall parallel to the major axis, the cover outer wall extending from the cover top surface to the cover outer wall; and cooperation of the major sidewall with the cover outer wall forming the interference fit:

capturing the removable cover in fixed position in the major recess, forming mated sealing engagement of the removable cover with the major sidewall to define the enclosed portion, and locating the filling projection in the minor recess in mating relationship therewith.

2. A traction cleat assembly according to claim 1, comprising:

the minor recess defining a driven fitting configured to receive a driving fitting in mating relationship therewith to enable manual removal of the traction cleat from the outsole by application of force from the driving fitting to the driven fitting to cause rotational movement of the connection stem relative to the outsole.

3. A traction cleat assembly according to claim 1, comprising:

the minor recess cross-sectional shape being a shape other than circular to define at least one driven surface, and the projection cross-sectional shape identical to the minor recess cross-sectional shape.

4. A traction cleat assembly according to claim 1, comprising:

the minor recess cross-sectional shape defining a star, the projection cross-sectional shape defining a star identical to the minor recess cross-sectional shape for mating relationship of the minor filling projection with the minor recess, the projection minor periphery defining an inner star-shaped periphery coextensive with the minor recess periphery defining an outer star-shaped periphery.

5. A traction cleat assembly according to claim 1, comprising:

the removable cover comprising a central spike extending downward from the cover bottom surface.

6. A traction cleat assembly according to claim 1, comprising:

the removable cover held in fixed position in the major recess by the interference fit defined between the cover major periphery and major sidewall.

7. A traction cleat assembly according to claim 6, comprising:

the interference fit further defining a snap-fit relationship between the cover major periphery and major sidewall.

8. A pair of golf shoes comprising a traction cleat assembly according to claim 1.

9. A plurality of the traction cleat assembly according to claim 1.

10. A traction cleat assembly for a golf shoe, said traction cleat assembly comprising:

a major hub comprising a hub body having a body periphery spaced from a major axis, wherein the hub body is configured to be intermediate a hub bottom surface and the golf shoe, the major hub comprising a plurality of traction elements spaced about the body periphery and extending downward from the hub body;

the hub body including a minor driven fitting comprising one of a female fitting and male fitting defined in the hub bottom surface, the minor driven fitting terminating intermediate the hub bottom surface and the hub top surface;

a removable cover affixed to the hub body by positive engagement, the removable cover comprising a one-piece structure having a cover top surface engaging the hub bottom surface, cooperation of the cover top surface with the hub bottom surface defining mated sealing engagement isolating the minor driven fitting from communication with an external environment; and the cover top surface including a minor filling fitting comprising one of a female fitting and male fitting defined therein and configured to be received in mating engagement with the minor driven fitting when the removable cover is affixed to the hub body in a fixed position relative to same by the positive engagement, the minor filling fitting terminating intermediate the hub bottom surface and the hub top surface.

11. A traction cleat assembly according to claim 10, comprising:

the minor driven fitting having a minor star-shaped cross-sectional shape, the minor drive fitting having an identical minor star-shaped cross-sectional shape and defining a complementary minor star-shaped cross-sectional shape identical to the minor drive fitting for mating relationship of the minor filling projection with the minor recess.

* * * * *